US010765924B2

(12) United States Patent
Brown et al.

(10) Patent No.: US 10,765,924 B2
(45) Date of Patent: Sep. 8, 2020

(54) LACROSSE HEAD HAVING A PINCHED BALL CONTAINMENT AREA

(71) Applicant: Wm. T. Burnett IP, LLC, Baltimore, MD (US)

(72) Inventors: Austin Scott Brown, Glen Rock, PA (US); Betsy Barnhart, Ames, IA (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 0 days.

(21) Appl. No.: 16/374,231

(22) Filed: Apr. 3, 2019

(65) Prior Publication Data

US 2020/0155910 A1 May 21, 2020

Related U.S. Application Data

(63) Continuation-in-part of application No. 29/670,695, filed on Nov. 19, 2018.

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/00; A63B 59/30; A63B 59/20; A63B 65/125; A63B 60/50; A63B 2102/14
USPC ..... 473/512–514, 493, 446, 471, 503; D21/724
See application file for complete search history.

(56) References Cited

U.S. PATENT DOCUMENTS

| | | | | |
|---|---|---|---|---|
| 3,507,495 | A | 4/1970 | Tucker et al. | |
| 4,034,984 | A | 7/1977 | Crawford et al. | |
| 5,566,947 | A | 10/1996 | Tucker et al. | |
| D519,176 | S | 4/2006 | Tucker, Jr. | |
| D523,101 | S | 6/2006 | Tucker, Jr. | |
| 7,407,455 | B2 * | 8/2008 | Tucker, Jr. ..... | A63B 59/20 473/513 |
| 7,488,266 | B2 | 2/2009 | Tucker, Jr. et al. | |
| 7,815,531 | B1 * | 10/2010 | Gait ..... | A63B 59/20 473/513 |

(Continued)

OTHER PUBLICATIONS

2003 STX Catalog Excerpts, PowerPlay, 2 pages.

(Continued)

*Primary Examiner* — John E Simms, Jr.
*Assistant Examiner* — Rayshun K Peng
(74) *Attorney, Agent, or Firm* — Plumsea Law Group, LLC

(57) ABSTRACT

Embodiments provide a lacrosse head with a pinched ball containment area. The head includes a juncture, a stop member adjoining the juncture, first and second sidewalls extending from the stop member in a forward direction, and a transverse wall connecting the first and second sidewalls opposite to the stop member. The adjoining transverse wall and first sidewall may form a first shoulder portion and the adjoining transverse wall and second sidewall may form a second shoulder portion, with the first and second shoulder portions defining an inside widest point perpendicularly across the bisecting line. Within a certain distance from the widest point in a rearward direction, the first sidewall and the second sidewall define a ball containment width that places the frame of the lacrosse head closer to a ball than an opposing lacrosse head during a draw.

20 Claims, 20 Drawing Sheets

(56) References Cited

U.S. PATENT DOCUMENTS

| | | | | |
|---|---|---|---|---|
| D645,530 | S | 9/2011 | Morrow et al. | |
| D655,362 | S | 3/2012 | Morrow et al. | |
| D660,930 | S | 5/2012 | Morrow et al. | |
| 10,286,271 | B2 | 5/2019 | Williams et al. | |
| 2006/0019778 | A1 | 1/2006 | Tucker, Jr. | |
| 2006/0205542 | A1 | 9/2006 | Tucker, Jr. et al. | |
| 2006/0264277 | A1 | 11/2006 | Tucker, Jr. et al. | |
| 2016/0199710 | A1 | 7/2016 | Barnhart | |
| 2017/0232315 | A1 | 8/2017 | Brown | |
| 2018/0133570 | A1* | 5/2018 | McDonell | A63B 59/20 |
| 2018/0185722 | A1 | 7/2018 | Miceli et al. | |
| 2018/0207498 | A1* | 7/2018 | Larson | A63B 60/50 |
| 2019/0168082 | A1 | 6/2019 | Tucker, Jr. | |

OTHER PUBLICATIONS

2004 STX Heat Lacrosse Head. Retrieved from the Internet: <http://www.laxroom.com/post/category/10343/STX/ listings/531/STX-Heat-Lacrosse-Head.html>.
2005 STX Catalog Excerpts, Deuce and Stingray, 3 pages.
2008 STX Catalog Excerpts, Thrash, 2 pages.
STX Arrow, SidelineSwap, Jun. 6, 2014 [retrieved May 25, 2018]. Retrieved from the Internet: <https://sidelineswap.wordpress.com/tag/stx-arrow/>.
Under Armour Regime Girls Lacrosse Stick Review, Mar. 12, 2015 [retrieved Apr. 3, 2019]. Retrieved from the Internet: <https://lacrossescoop.com/under-armour-regime-girls-lacrosse-stick-review/>.
STX Heat Lacrosse Head, Nov. 28, 2017 [retrieved Apr. 5, 2019]. Retrieved from the Internet: <https://d.facebook.com/lacrosseman1/photos/a.439819619480981/1365797740216493/?type=3&_tn_=EH-R>.
STX Exult 600 Limited Edition, May 9, 2018 [retrieved Apr. 5, 2019]. Retrieved from the Internet: <https://www.instagram.com/p/BikbEWqF7it/>.
STX Exult 600 Limited Edition, May 10, 2018 [retrieved Apr. 5, 2019]. Retrieved from the Internet: <https://www.instagram.com/p/Bim0qIHFj4y/>.
Universal Lacrosse Blog Exult 600, Jun. 1, 2018 [retrieved Apr. 5, 2019]. Retrieved from the Internet: <https://www.universallacrosse.com/blog/stx-releases-highly-anticipated-ultra-power-and-exult-600/>.
STX Crux 600, Sep. 7, 2018 [retrieved Apr. 3, 2019]. Retrieved from the Internet: <https://web.archive.org/web/20180907193147/https://www.stx.com/crux-600>.
Design U.S. Appl. No. 29/613,067, filed Aug. 7, 2017.
NCAA Men's Lacrosse 2019 and 2020 Rules.
NCAA Women's Lacrosse 2016 and 2017 Rules.
NCAA Women's Lacrosse 2018 and 2019 Rules.

* cited by examiner

LACROSSE HEAD HAVING A PINCHED BALL CONTAINMENT AREA

This is a continuation-in-part of U.S. Design application No. 29/670,695, filed Nov. 19, 2018, which is herein incorporated by reference in its entirety.

BACKGROUND

Field

The present embodiments relate generally to lacrosse equipment, and more particularly, to a lacrosse head having a pinched ball containment area. In embodiments, the lacrosse head may have sidewalls providing a narrow ball containment width in the forward portion of the head, which may enhance ball control during a draw to aid in gaining possession of the ball.

Background

Lacrosse players prefer lacrosse sticks that maximize ball control while performing game skills. In women's lacrosse in particular, one skill of recently increasing significance is the draw, which occurs at the start or resumption of play and involves two players competing for possession of the ball. During a draw, a ball is placed between the backs of two lacrosse heads held together by two opposing players. After a whistle is blown, the players draw their lacrosse sticks up and away, sending the ball above the heads of the players. The players then compete for possession of the ball.

Controlling how the ball is propelled upwardly during the draw can determine who gains possession of the ball. Thus, lacrosse players—in particular, "draw specialists"—desire lacrosse heads that promote ball control during draws.

SUMMARY

Embodiments provide a lacrosse head having a pinched ball containment area.

An embodiment provides a lacrosse head for controlling a ball having a diameter, the lacrosse head having a juncture, stop member, first and second sidewalls, and a transverse wall. The juncture may be configured to receive a handle, a majority length of the handle defining a horizontal centerline when the lacrosse head is viewed from a side view and a bisecting line when the lacrosse head is viewed from a front view. The stop member may adjoin the juncture. The first sidewall may extend from the stop member in a forward direction. The second sidewall may extend from the stop member in the forward direction. The transverse wall may connect the first sidewall and the second sidewall opposite to the stop member. The adjoining transverse wall and first sidewall may form a first shoulder portion of the lacrosse head and the adjoining transverse wall and second sidewall may form a second shoulder portion of the lacrosse head. The first shoulder portion and the second shoulder portion may define an inside widest point of the lacrosse head perpendicularly across the bisecting line when viewed from the front view. Within a distance from the widest point in a rearward direction equal to about half of the diameter, the first sidewall and the second sidewall may define a ball containment width equal to or less than about 1.8 times the diameter.

In an aspect, the diameter may be approximately 63 mm and the ball containment width may be 114 mm or less.

In another aspect, the first sidewall and the second sidewall may define the ball containment width within a distance from the widest point in a rearward direction equal to about ¼ of the diameter.

In another aspect, the first sidewall and the second sidewall may define the ball containment width immediately adjacent to the widest point.

In another aspect, when viewed from the side view, a first lower edge of the first sidewall may define a first downward protrusion at the ball containment width, and a second lower edge of the second sidewall may define a second downward protrusion at the ball containment width.

In another aspect, when viewed from the side view, the first lower edge of the first sidewall may define a first adjacent lower edge portion rearward and upward of the first downward protrusion, and the second lower edge of the second sidewall may define a second adjacent lower edge portion rearward and upward of the second downward protrusion. The first adjacent lower edge portion and the second adjacent lower edge portion may extend generally parallel to the horizontal centerline. The first adjacent lower edge portion and the first downward protrusion may form a first recessed area, and the second adjacent lower edge portion and the second downward protrusion may form a second recessed area, such that the first recessed area and the second recessed area are configured to receive a scoop of an opposing lacrosse head placed back-to-back with the lacrosse head.

Another embodiment provides a lacrosse head having a juncture, stop member, first and second sidewalls, and a transverse wall. The juncture may be configured to receive a handle, a majority length of the handle defining a horizontal centerline when the lacrosse head is viewed from a side view and a bisecting line when the lacrosse head is viewed from a front view. The stop member may adjoin the juncture. The first sidewall may extend from the stop member in a forward direction. The second sidewall may extend from the stop member in the forward direction. The transverse wall may connect the first sidewall and the second sidewall opposite to the stop member. The adjoining transverse wall and first sidewall may form a first shoulder portion of the lacrosse head and the adjoining transverse wall and second sidewall may form a second shoulder portion of the lacrosse head. The first shoulder portion and the second shoulder portion may define an inside widest point of the lacrosse head perpendicularly across the bisecting line when viewed from the front view. The first sidewall may have a first longitudinal portion extending longitudinally with respect to the bisecting line and a first lateral portion extending from the first longitudinal portion to the first shoulder portion laterally with respect to the bisecting line. When viewed from the front view, the first longitudinal portion and the first lateral portion may meet at a first interior elbow portion at an angle within a range of about 60 degrees to about 130 degrees. The second sidewall may have a second longitudinal portion extending longitudinally with respect to the bisecting line and a second lateral portion extending from the second longitudinal portion to the second shoulder portion laterally with respect to the bisecting line. When viewed from the front view, the second longitudinal portion and the second lateral portion may meet at a second interior elbow portion at an angle within a range of about 60 degrees to about 130 degrees.

In an aspect, the first longitudinal portion and the first lateral portion may meet at the first interior elbow portion at an angle within a range of about 75 degrees to about 115 degrees, and the second longitudinal portion and the second lateral portion may meet at the second interior elbow portion at an angle within a range of about 75 degrees to about 115 degrees.

In another aspect, the first interior elbow portion and the second interior elbow portion may be rounded.

In another aspect, the lacrosse head may define an overall length along the bisecting line from an inside point on the stop member to a top outside point on the transverse wall. From a midpoint of the overall length in a forward direction, an innermost edge of the first longitudinal portion of the first sidewall may extend from the midpoint to the first interior elbow portion and have an angle of divergence from parallel to the bisecting line in at least one of the forward or rearward directions that is not greater than 25 degrees. From the midpoint of the overall length in the forward direction, an innermost edge of the second longitudinal portion of the second sidewall may extend from the midpoint to the second interior elbow portion and have an angle of divergence from parallel to the bisecting line in at least one of the forward or rearward directions that is not greater than 25 degrees.

In another aspect, an innermost edge of the first lateral portion of the first sidewall may extend from the first interior elbow portion to the first shoulder portion within a range of 25 degrees of perpendicular to the bisecting line when viewed from the front view, and an innermost edge of the second lateral portion of the second sidewall may extend from the second interior elbow portion to the second shoulder portion within a range of 25 degrees of perpendicular to the bisecting line when viewed from the front view.

In another aspect, the lacrosse head may define an overall length along the bisecting line from an inside point on the stop member to a top outside point on the transverse wall. From a midpoint of the overall length moving in a forward direction, a ball containment width between an innermost edge of the first longitudinal portion and an innermost edge of the second longitudinal portion, measured perpendicularly across the bisecting line, may reach a minimum width of 114 mm or less, and the widest interior point may be at least 159 mm.

In another aspect, from a point disposed on the bisecting line 163 mm from an inside point on the stop member moving in a forward direction, a ball containment width between an innermost edge of the first longitudinal portion and an innermost edge of the second longitudinal portion, measured perpendicularly across the bisecting line, may reach a minimum width of 114 mm or less, and the widest interior point may be at least 159 mm.

In another aspect, when viewed from the side view, a first lower edge of the first sidewall may define a first downward protrusion at the first interior elbow portion, and a second lower edge of the second sidewall may define a second downward protrusion at the second interior elbow portion.

In another aspect, the first downward protrusion and the second downward protrusion may be round.

In another aspect, the first lower edge at the first downward protrusion may lie along an approximately 90 degree arc of a circle, and the second lower edge at the second downward protrusion may lie along an approximately 90 degree arc of a circle.

In another aspect, when viewed from the front view, the lacrosse head may define a first gap extending generally parallel to the bisecting line between the first interior elbow portion and a first innermost point of the transverse wall, and a second gap extending generally parallel to the bisecting line between the second interior elbow portion and a second innermost point of the transverse wall, with each of the first gap and the second gap being shorter than a diameter of a lacrosse ball with which the lacrosse head is used.

In another aspect, each of the first gap and the second gap may be shorter than 62.7 mm.

In another aspect, the first lateral portion of the first sidewall may define a string channel leading to a string hole through the shoulder portion.

Another embodiment provides a lacrosse stick for controlling a ball having a diameter, the lacrosse stick having a handle and a head. The head may have a juncture, stop member, first and second sidewalls, and a transverse wall. The juncture may be configured to receive the handle, a majority length of the handle defining a horizontal centerline when the lacrosse stick is viewed from a side view and a bisecting line when the lacrosse stick is viewed from a front view. The stop member may adjoin the juncture. The first sidewall may extend from the stop member in a forward direction. The second sidewall may extend from the stop member in the forward direction. The transverse wall may connect the first sidewall and the second sidewall opposite to the stop member. The adjoining transverse wall and first sidewall may form a first shoulder portion of the lacrosse head and the adjoining transverse wall and second sidewall may form a second shoulder portion of the lacrosse head. The first shoulder portion and the second shoulder portion may define an inside widest point of the lacrosse head perpendicularly across the bisecting line when viewed from the front view. Within a distance from the widest point in a rearward direction equal to about half of the diameter, the first sidewall and the second sidewall may define a ball containment width equal to or less than about 1.8 times the diameter.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Embodiments provide a lacrosse head having a pinched ball containment area that may enhance ball control during a draw.

Figure 1:
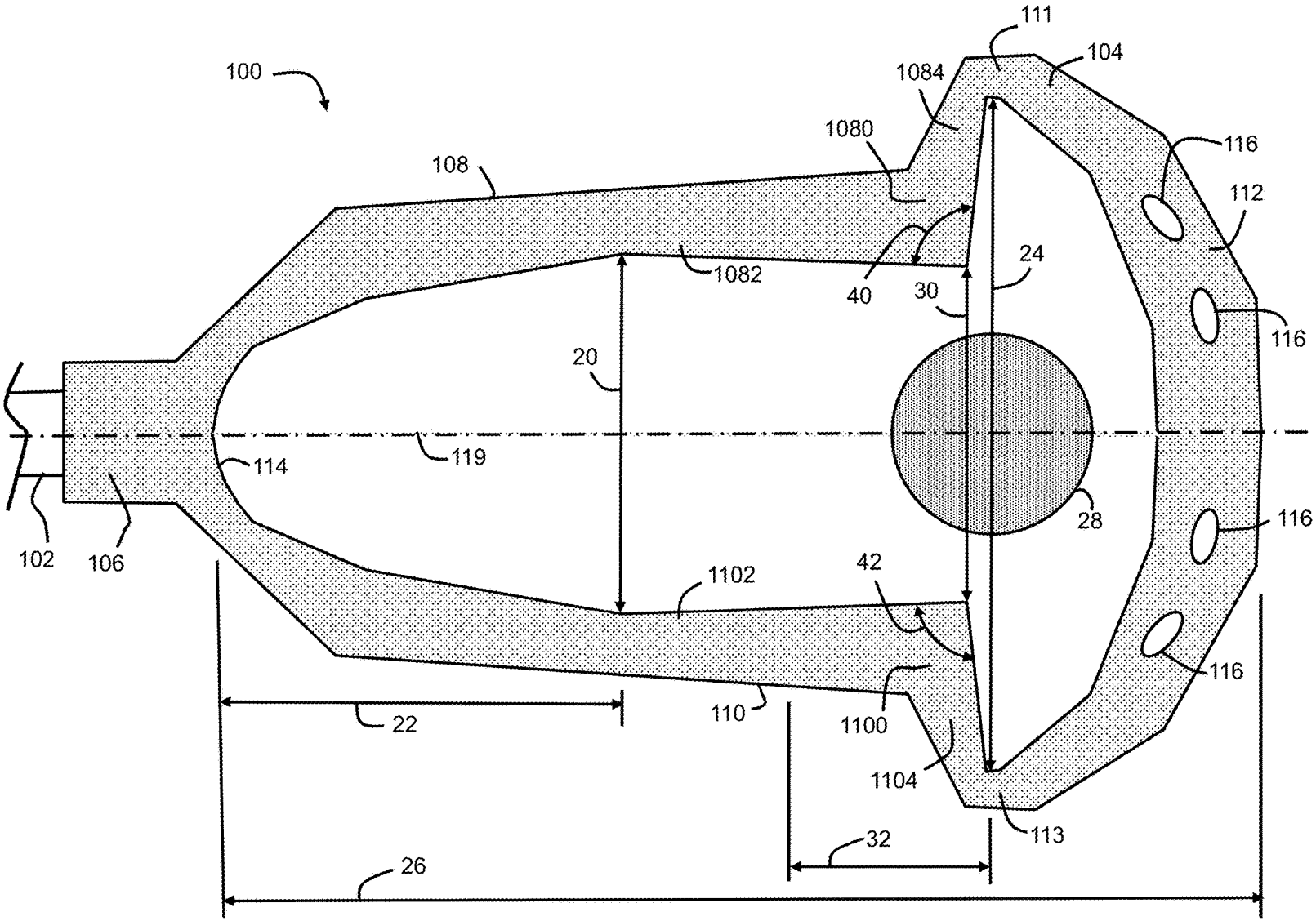
FIGS. 1 and 2 are schematic diagrams of front views of a lacrosse stick having a pinched ball containment area, according to an embodiment.

FIG. 1 illustrates a representative embodiment of a lacrosse stick 100, including a handle 102 (partially shown) and a double-wall synthetic head 104. As used herein, "stick" refers to the stick as a whole, including the head and the handle. Head 104 may have a generally V-shaped frame having a juncture 106, sidewalls 108 and 110, a transverse wall (or "scoop") 112 joining the sidewalls at their ends opposite juncture 106, and a stop member (or "ball stop") 114 adjoining juncture 106 and joining sidewalls 108 and 110 at their ends nearest juncture 106. The frame may be considered to extend from a rearward end at the juncture 106 to a forward end at the transverse wall 112. As shown, handle 102 may fit into and through juncture 106, may abut stop member 114, and may define (by a majority length of the handle) a horizontal centerline of the handle 102 and head 104 as shown, for example, in a side elevational view of head 104, as well as a bisecting line 119 as shown, for example, in the front view of FIG. 1 (bisecting the head 104 longitudinally into two halves). Screws or other fasteners may be placed through openings (not shown) in juncture 106, securing handle 102 to head 104. Features of lacrosse sticks are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

In embodiments, lacrosse stick head 104 may have a "traditional" pocket configuration, a "mesh" pocket configuration, or a combination of both configurations. The traditional pocket may include thongs made of leather or synthetic material strung from forward thong holes 116 in transverse wall 112 to rearward thong holes in stop member 114. To complete the pocket web, the thongs may have nylon strings threaded around the thongs and string laced through string holes in sidewalls 108 and 110, forming any number of diamonds or other shapes (crosslacing).

In traditional pockets, thongs (not shown in FIG. 1) made of leather or synthetic material may extend from forward thong holes 116 in transverse wall 112 to rearward thong holes in stop member 114. As one embodiment, FIG. 1 shows four thong holes 116 that may accept four thongs. Other numbers of thongs and thong holes may be used. To complete the pocket web, nylon strings may be threaded around the thongs and string may be laced through string holes in sidewalls 108 and 110, forming any number of diamonds or other shapes (crosslacing). In embodiments, one or more throwing or shooting strings may extend transversely between the forward portions of sidewalls 108 and 110, attaching to throwing string holes defined in the sidewalls 108 and 110. In embodiments, a thong may not be attached directly to a thong hole, and instead may be connected to a separate material that attaches the thong to the lacrosse head frame and that is easier to adjust through the thong hole. In addition, in some embodiments, a top string (e.g., nylon string) may be strung along the thong holes of the scoop, and the thongs may be attached to the top string.

A mesh pocket configuration may use a mesh knitted as a continuous piece of material. This continuous piece of material may attach to the lacrosse head as a single unit. The mesh may be attached to the lacrosse head using transverse lacing, which may reinforce the web of the mesh that is adjacent to the lacrosse head.

As exemplified in FIG. 1, embodiments may include provisions for improving the performance of a women's lacrosse stick, especially with respect to draw maneuvers, and within the context of rules governing the configuration of a women's lacrosse head. In particular, certain rules for women's lacrosse (e.g., NCAA Women's Lacrosse 2018 and 2019 Rules, Appendix E, Section 18.d and 18.e) require that the inside width 20 between the sidewalls 108 and 110 of the head 104, as measured a distance 22 of 10.2 cm (102 mm) from the center of ball stop 114, be 8.7 cm minimum, and that the inside width between the walls at the widest point 24 at the top of the head 104 be a distance of 16.0 cm minimum. Certain rules also dictate that the overall length of the head, as measured from the center of the ball stop (where the top, back edge of the stop pad meets the plastic) to the top outside edge of the scoop, be a distance 26 between 25.4 cm minimum to 30.5 cm maximum (e.g., NCAA Women's Lacrosse 2018 and 2019 Rule 2, Section 23). Other rules (e.g., NCAA Men's Lacrosse 2018 and 2019 Rules, Appendix IV) specify that a lacrosse ball 28 may measure between 7¾ and 8 inches in circumference, which corresponds to a diameter within a range of 2.47 inches (62.7 mm) to 2.55 inches (64.8 mm). Within one or more of those restrictions, embodiments provide a favorable lacrosse head geometry that enhances ball control during a women's lacrosse draw to aid in gaining possession of the ball. Although embodiments are described herein in the context of women's lacrosse sticks and rules, embodiments are also applicable to men's lacrosse sticks, rules, and performance characteristics, including aspects relating to containing and controlling a lacrosse ball on the backside of a forward portion of a lacrosse head during a face-off, the men's game version of a draw.

As shown in the embodiment of FIG. 1, lacrosse head 104 may have a pinched forward portion that positions the innermost edges of sidewalls 108 and 110 relatively close to longitudinal bisecting line 119 to define a relatively narrow ball containment width 30 of head 104 near the widest point 24 along the longitudinal bisecting line 119. In embodiments, the ball containment width 30 is provided as close to widest point 24 as possible. For example, as shown in FIG. 1, relatively sharp interior elbow portions of sidewalls 108 and 110, in combination with a rapid increase in width may allow ball containment width 30 to be disposed close to widest point 24 along the longitudinal bisecting line 119. Embodiments may provide this dramatic change in width by configuring each of sidewalls 108 and 110 with an elbow portion connecting a generally longitudinal portion to a generally lateral portion. For example, as shown in FIG. 1, sidewall 108 may include an elbow portion 1080 joining a generally longitudinal portion 1082 and a generally lateral portion 1084, while similarly, sidewall 110 may include an elbow portion 1100 joining a generally longitudinal portion 1102 and a generally lateral portion 1104. In embodiments, the longitudinal, elbow, and lateral portions refer to the inside structures of the sidewalls, which may provide the ball control aspects described herein.

To position ball containment width 30 close to widest point 24, an innermost edge of lateral portion 1084 of first sidewall 108 may extend from the interior corner of elbow portion 1080 to shoulder portion 111 within a range of ±25 degrees of perpendicular to longitudinal bisecting line 119 when viewed from a front view, as in FIG. 1. Similarly, an innermost edge of lateral portion 1104 of first sidewall 110 may extend from the interior corner of elbow portion 1100 to shoulder portion 113 within a range of ±25 degrees of perpendicular to longitudinal bisecting line 119 when viewed from a front view.

Figure 15:
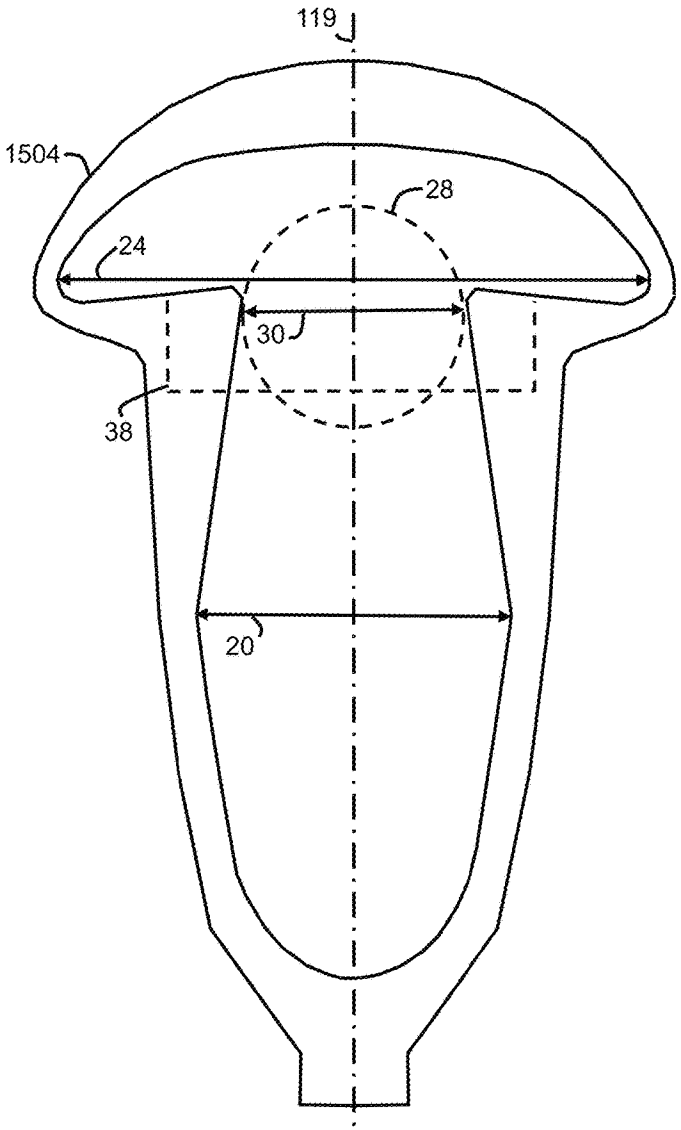
FIGS. 15-19 are schematic diagrams of front views of lacrosse heads with alternative sidewall configurations, according to alternative embodiments.
Figure 16:
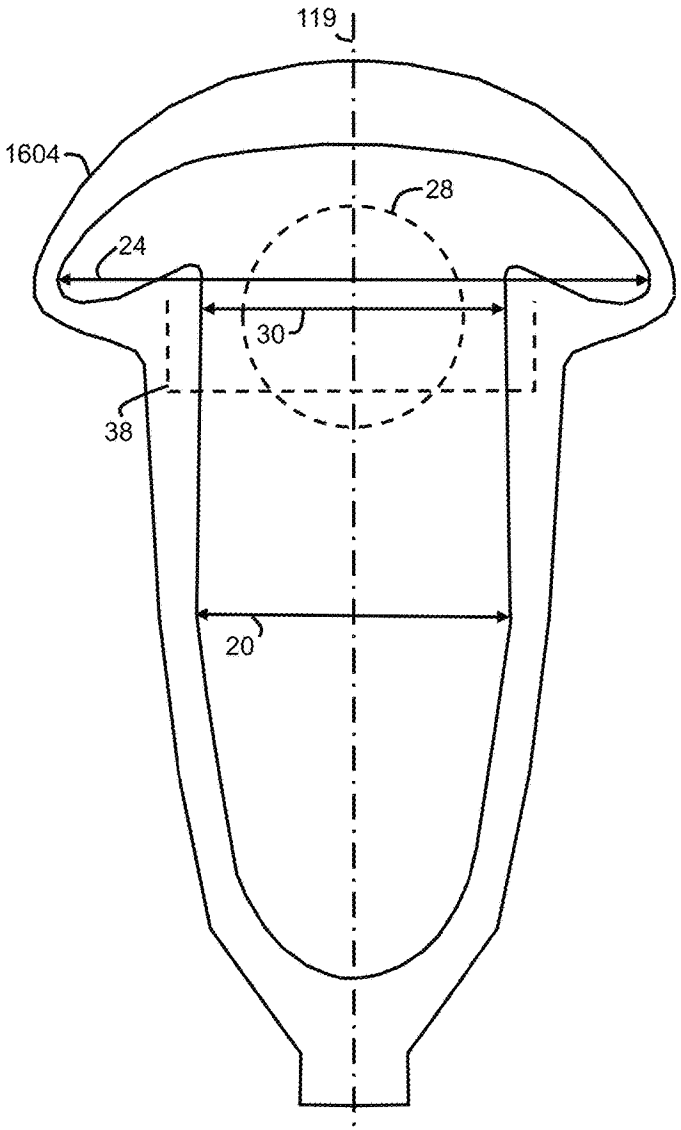

In embodiments, ball containment width 30 may be disposed within a distance from widest point 24 measured along longitudinal bisecting line 119, equal to or less than about half the diameter of a lacrosse ball 28 with which head 104 is used. For example, based on widely accepted dimensions of a lacrosse ball (e.g., a 63 mm-diameter ball), ball containment width 30 may be disposed within a distance of about 31.5 mm or less from widest point 24. In particular implementations, ball containment width 30 may be disposed closer to widest point 24, for example, a distance equal to about ¼ of the diameter of a lacrosse ball (e.g., about 16 mm for a 63 mm-diameter ball). In other implementations, ball containment width 30 may be disposed immediately adjacent to widest point 24, for example, when the inside edge of the generally lateral portion (1084 or 1104) is perpendicular to, or even beyond perpendicular to (e.g., extending in both a lateral and a forward-to-rearward direction, examples of which are shown in FIGS. 15 and 16, described below), the longitudinal bisecting line 119. This positioning of ball containment width 30 may enable better control of ball 28 when ball 28 is placed on the back side of the forward portion of head 104 between sidewalls 108 and 110 and shoulder portions 111 and 113.

As shown in FIG. 1, the pinched configuration in the forward portion of head 104 contains ball 28 within a smaller width across longitudinal bisecting line 119. In extreme embodiments, ball containment width 30 may be slightly larger than a diameter of a lacrosse ball with which head 104 is used. For example, ball containment width 30 may be as small as about 63 mm. In other embodiments, ball containment width 30 may be greater and still provide desired ball control. For example, within a longitudinal distance 32 in the rearward direction of widest point 24 equal to about half a diameter of a ball with which head 104 is used (e.g., 31.5 mm for a 63 mm-diameter ball), ball containment width 30 may reach a minimum width within a range of about 63 mm to about 114 mm, and provide desired ball control. In other words, for example, the ball containment width 30 may reach a minimum width within a range of about 1 times to about 1.8 times the ball diameter. In one implementation, ball containment width 30 may reach a minimum width within a range of about 63 mm to about 103 mm, or about 1 times to about 1.7 times the ball diameter.

Figure 2:
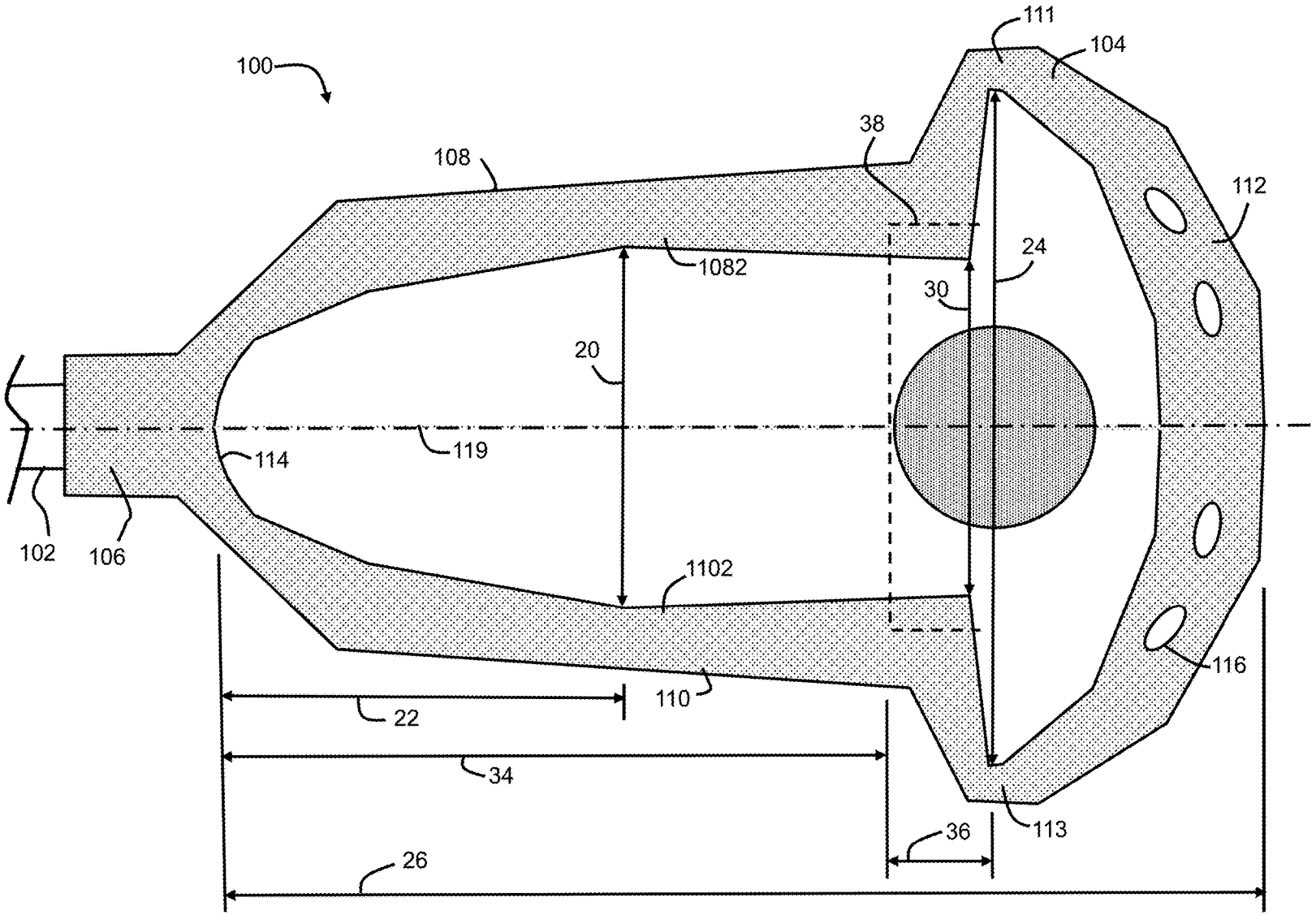

Embodiments may also provide a relatively narrow ball containment width within a containment zone that is located with respect to the center of the ball stop. As shown in FIG. 2, for example, embodiments may locate ball containment width 30 within containment zone 38, which begins a distance 34 from the center of ball stop 114 and extends in the forward direction toward widest point 24. In a particular implementation, containment zone 38 may begin at a distance 34 of approximately 163 mm from the center of ball stop 114, and within that containment zone 38, ball containment width may reach a minimum width within a range of about 63 mm to about 114 mm, centered across longitudinal bisecting line 119. Proportionally, distance 34 at which ball containment zone 38 begins may be approximately 53% to approximately 64% of the overall length of head 24 as measured at distance 26, based on an approximate distance 34 of 163 mm and an overall length (distance 26) of head 104 ranging from about 254 mm minimum to about 305 mm maximum, according to widely accepted rules dictating women's lacrosse head dimensions. In one implementation, distance 34 is approximately 63% of distance 26, based on an approximate distance 34 of 163 mm and an overall length (distance 26) of approximately 259 mm.

In embodiments, the ball containment width may be provided in the forward portion of head, where the forward portion starts at approximately a midpoint of the overall length of the head measured along the longitudinal bisecting line from an inside point on the stop member to a top outside on the transverse wall. In embodiments, the midpoint may be a distance from stop member ranging from about 127 mm to about 152.5 mm, based on an overall length (distance 26) of head 104 ranging from about 254 mm minimum to about 305 mm maximum. Referring to FIG. 2, a midpoint would be half of distance 26. In an exemplary implementation, with a lacrosse head having a widest point 24 of about 159 mm, from the midpoint moving in a forward direction toward widest point 24, the ball containment width 30 between the innermost edge of first longitudinal portion 1082 and the innermost edge of second longitudinal portion 1102, measured perpendicularly across longitudinal bisecting line 119, would reach a minimum width of at least 114 mm within a distance in the rearward direction of widest point 24 equal to about half a diameter of a ball with which head 104 is used. In particular embodiments, which may provide a smaller containment area and more ball control, ball containment width 30 would reach a minimum width of about 103 mm, and in extreme embodiments may reach a minimum width slightly wider than a diameter of a typical lacrosse ball, e.g., 63 mm.

In embodiments, to provide a narrow ball containment width 30 in a containment zone 38, lateral and longitudinal portions of a sidewall may be joined by the elbow portion at angles to each other. For example, referring to FIG. 1, longitudinal portion 1082 and lateral portion 1084 may meet at elbow portion 1080 at angle 40 within a range of about 60 degrees to about 130 degrees. In other embodiments, longitudinal portion 1082 and lateral portion 1084 may meet at elbow portion 1080 at angle 40 within a range of about 75 degrees to about 115 degrees. Longitudinal portion 1102, lateral portion 1104, and elbow portion 1100 may be similarly configured, with angle 42. In embodiments, the configurations of the lateral, longitudinal, and elbow portions of sidewalls 108 and 110 may be the same so that the configurations are symmetrical. In other embodiments, the configurations may be different from each other to provide an asymmetrical configuration.

As shown in FIG. 1, elbow portions 1080 and 1100 may provide sharp interior corners with vertices. In alternative embodiments, elbow portions 1080 and 1100 may provide rounded interior corners, in which case the angles of the longitudinal and lateral portions may be measured beyond the rounded corner.

Referring to FIGS. 15-19, embodiments may provide alternative sidewall configurations for forming a narrow ball containment width 30 in a containment zone 38 of a lacrosse head. In these examples, as a reference, ball containment zone 38 begins at approximately a distance in the rearward direction from widest point 24 along longitudinal bisecting line 119 equal to half a diameter of a lacrosse ball 28 (e.g., 31.5 mm for a 63 mm-diameter ball). As shown, within that containment zone 38, each sidewall configuration of FIGS. 15-19 reaches a minimum ball containment width 30. The sidewall configurations of FIGS. 15 and 17-19 provide a minimum ball containment width 30 slightly larger than the diameter of ball 28. The sidewall configuration of FIG. 16 reaches a minimum ball containment width 30 that is greater than those of FIGS. 15 and 17-19, e.g., ⅓ larger than the diameter of the ball 28.

As shown in FIG. 15, a head 1504 may include sidewalls having longitudinal portions moving closer to longitudinal bisecting line 119 as the longitudinal portions extend in the forward direction, and lateral portions that extend toward longitudinal bisecting line 119 and in a forward direction, meeting at acutely angled elbow portions (e.g., about 75 degrees).

As shown in FIG. 16, a head 1604 may include sidewalls having longitudinal portions extending generally parallel to longitudinal bisecting line 119 in the forward direction, and lateral portions that extend toward bisecting line 24 and in a forward direction greater than the configuration of FIG. 15, but also meeting at acutely angled elbow portions (e.g., also about 75 degrees).

Figure 17:
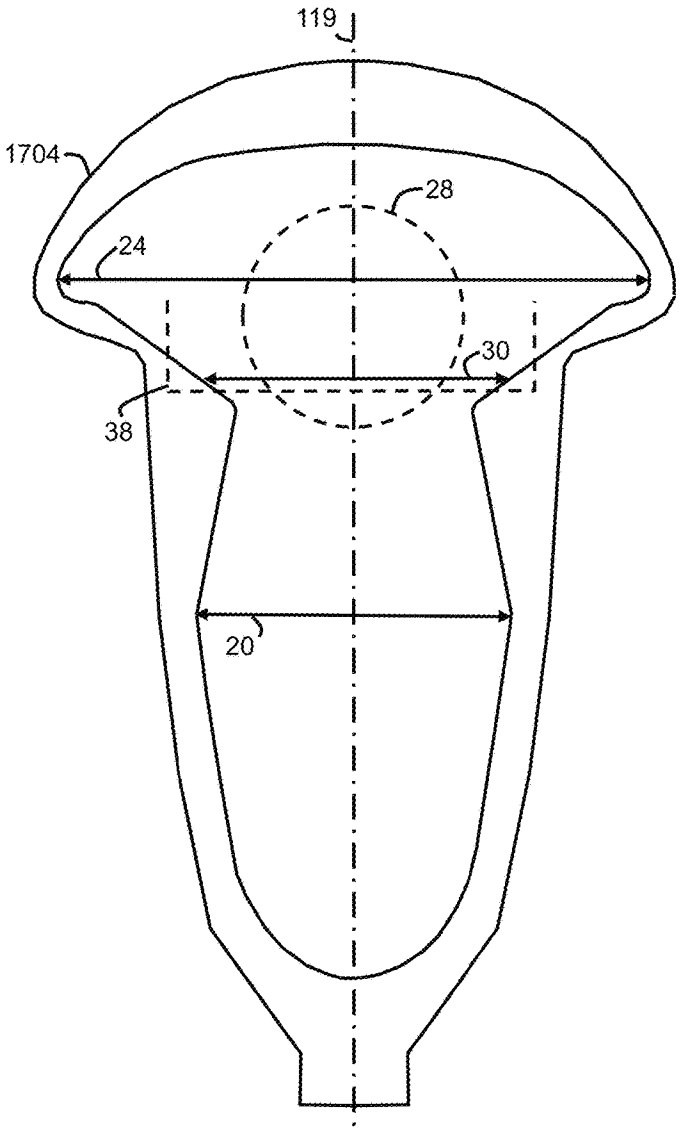

As shown in FIG. 17, a head 1704 may include sidewalls having elbow portions in a more rearward position, as compared to the embodiments of FIGS. 15 and 16. The sidewalls may have longitudinal portions moving closer to longitudinal bisecting line 119 as the longitudinal portions extend in the forward direction, and lateral portions that extend toward longitudinal bisecting line 119 and in a rearward direction, meeting at obtusely angled elbow portions (e.g., about 115 degrees).

Figure 18:
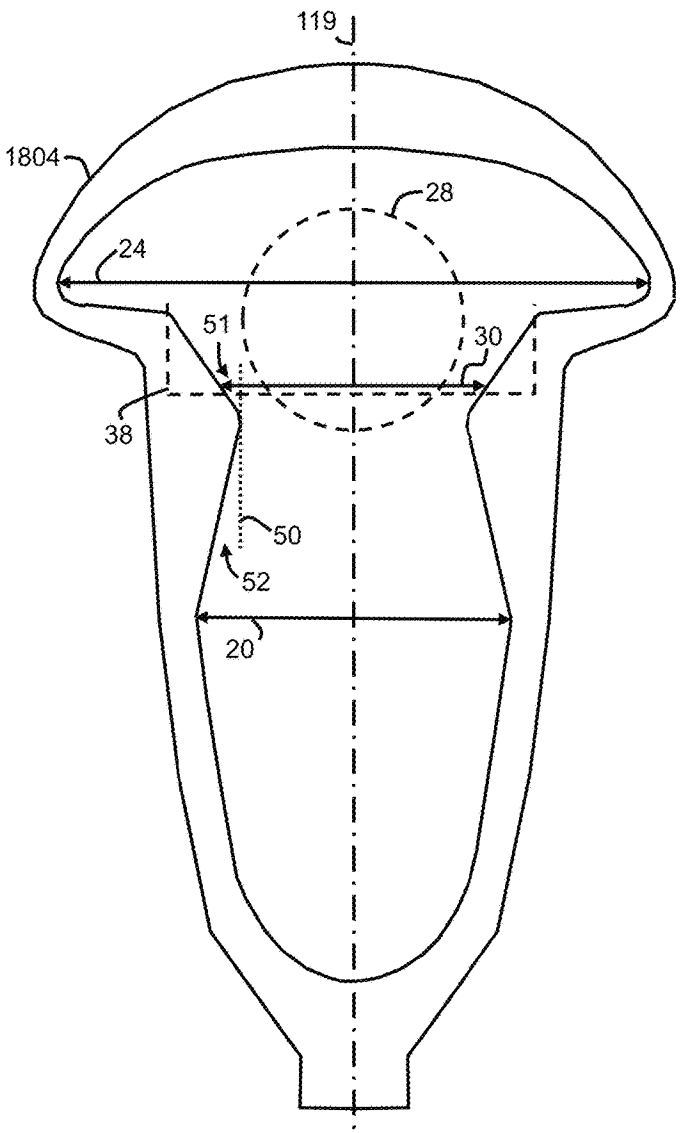

Embodiments may also include sidewalls having more than two portions, as well as continuous or indistinct portions, provided by rounded or freeform shapes. As shown in FIG. 18, a head 1804 may include sidewalls each having a generally lateral portion and a generally longitudinal portion having two sub-portions. The two generally longitudinal sub-portions may form an elbow at which a minimum width is provided, as well as an overall hourglass shape, with the minimum ball containment width 30 provided forward of the minimum width and within containment zone 38. Head 1804 may define an overall length along longitudinal bisecting line 119 from an inside point on the stop member to a top outside point on the transverse wall. From a midpoint of the overall length in a forward direction, an innermost edge of the first longitudinal portion of the first sidewall may extend from the midpoint to the first interior corner and may have an angle of divergence from parallel 50 to longitudinal bisecting line 119 in at least one of the forward 51 or rearward 52 directions that is not greater than 25 degrees. Likewise, from the midpoint of the overall length in the forward direction, an innermost edge of the second longitudinal portion of the second sidewall extends from the midpoint to the second interior corner and has an angle of divergence from parallel to longitudinal bisecting line 119 in at least one of the forward or rearward directions that is not greater than 25 degrees.

Figure 19:
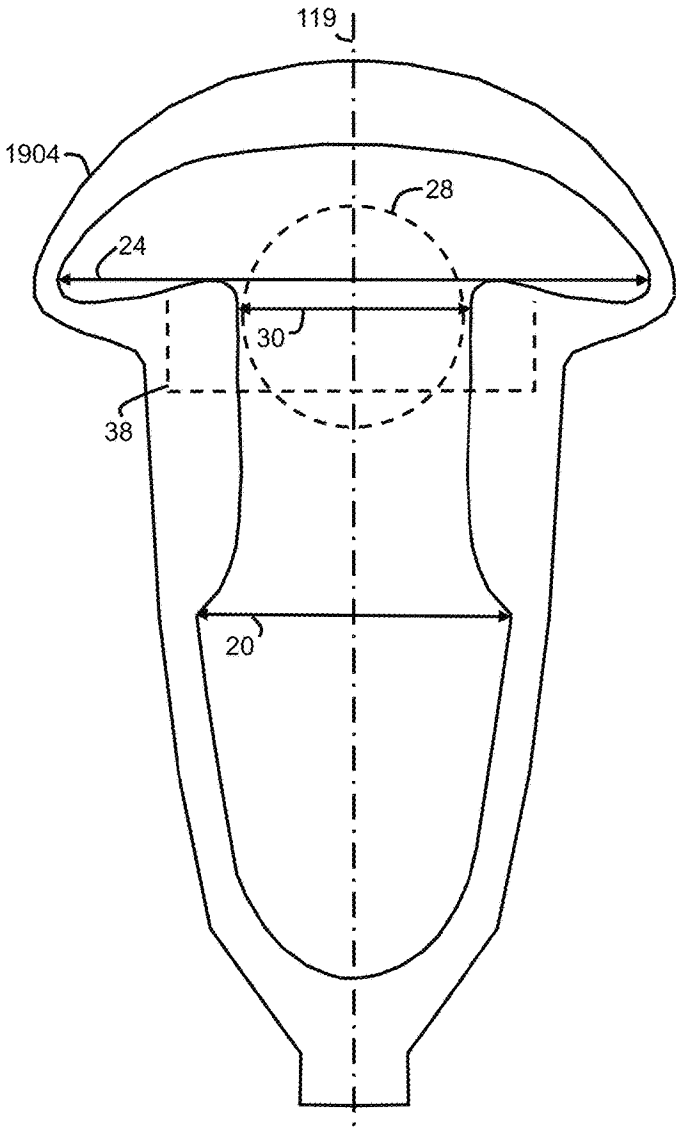

As shown in FIG. 19, a head 1904 may include sidewalls having freeform shapes that provide a minimum ball containment width 30 through the ball containment zone 38.

Thus, notwithstanding the particular pinched sidewall configurations described herein, the present embodiments should be considered broadly applicable to any lacrosse head constructions that position sidewalls close to each other in the forward portion of the head, near the widest point of the head, and within a certain distance in the rearward direction of the widest point, such as a distance equal to approximately the half diameter of a typical lacrosse ball.

Figure 3:
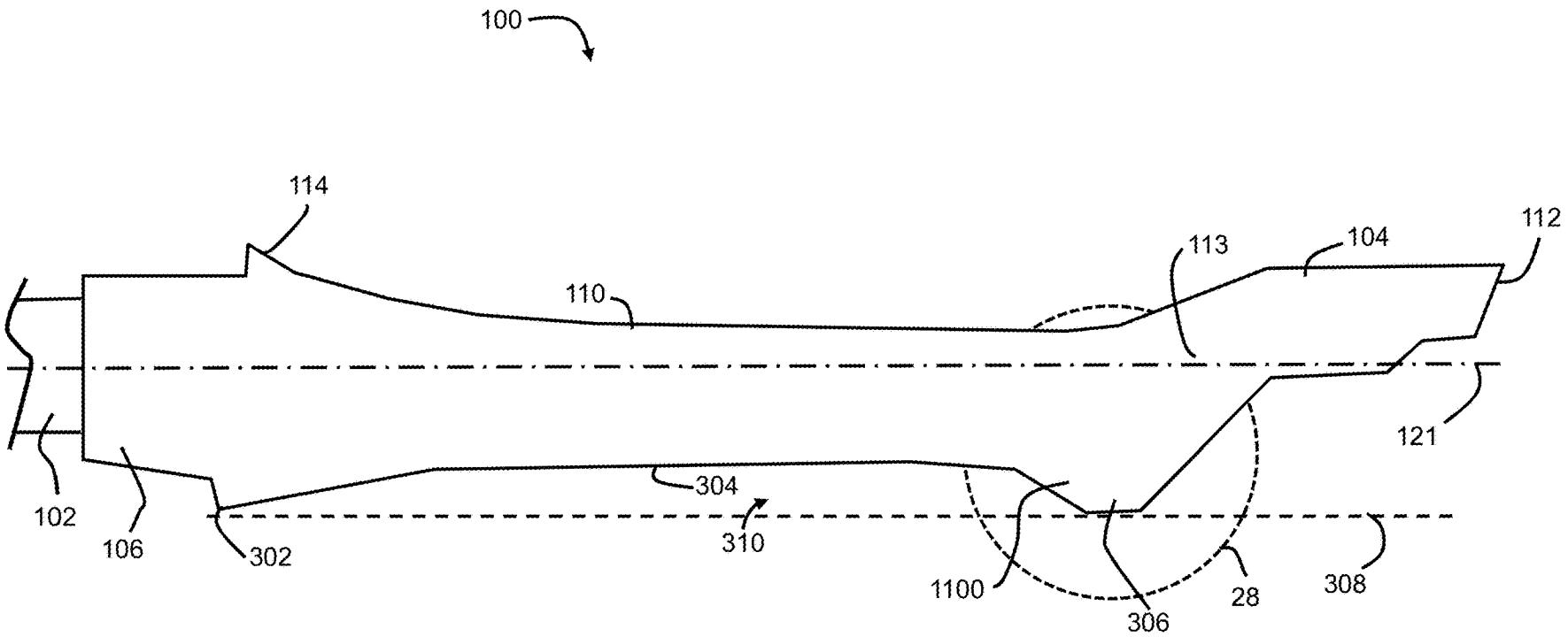
FIG. 3 is a schematic diagram of a side elevational view of the lacrosse stick of FIGS. 1 and 2.

In addition to a pinched forward head configuration, embodiments may include provisions for extending the pinched configuration into the frame of an opposing lacrosse head against which a head of the present embodiments is placed back-to-back during a draw. As shown in the side view of FIG. 3, head 104 may include downward protrusions 306 on each of sidewalls 108 and 110 (the opposite side view of FIG. 3 is a mirror image in this embodiment), which when viewed from the side view, protrude downwardly away from horizontal centerline 121, which may be defined by a majority length of handle 102. The protrusions 306 may be formed by the elbow portions 1100 and 1080, which also provide the minimum ball containment width 30 in this embodiment, as shown in FIGS. 1-2. The protrusions 306 protrude downwardly with respect to the adjacent lower edges 304 of the sidewalls 108 and 110 disposed in the rearward direction, and with respect to the shoulder portions 111 and 113 disposed in the forward direction. The lower edges 304 of sidewalls 108 and 110 may extend generally parallel to horizontal centerline 121 and may join stop member 114, which descends moving in a rearward direction to a lowermost point 302. In embodiments, lowermost point 302 of stop member 114 and a lowermost point of protrusions 306 may be generally disposed on a plane 308 that is generally parallel to horizontal centerline 121. In addition, lower edges 304 of sidewalls 108 and 110 may be generally parallel to horizontal centerline 121.

In embodiments, the raised lower edges 304 and downward protrusions 306 may cooperate with complementary structures of the back of an opposing lacrosse head during a draw, and provide a ball containment area within the frame of the opposing lacrosse head. In particular, with an embodiment placed back-to-back with an opposing lacrosse head, the recessed area 310 formed by stop member 114, lower edges 304, and protrusions 306 may receive the scoop of the opposing lacrosse head, while protrusions 306 may protrude into the pocket of the opposing lacrosse head and, notably, inside of the scoop, shoulder portions, and sidewalls of the opposing lacrosse head. With that configuration, the frame of head 104 may reach up and over the scoop of the opposing lacrosse head, and extend deep within the frame of the opposing lacrosse head. As represented by the dashed lines in FIG. 3, a ball 28 placed between the backs of the heads may then be contained inside protrusions 306, such that ball 28 is closer to the frame of head 104 than to the frame of the opposing lacrosse head.

Incorporating aspects described above in reference to FIGS. 1-3, an embodiment provides a lacrosse stick 200 having both a pinched ball containment area in the forward portion of the head 204, and also downwardly extending protrusions in the forward portion, as shown in FIGS. 4-10. Lacrosse stick 200 may include a handle 202 (partially shown in FIGS. 5-8) and a double-wall synthetic head 204. Head 204 may have a generally V-shaped frame having a juncture 206, sidewalls 208 and 210, a transverse wall 212 joining the sidewalls 208 and 210 at their ends opposite juncture 206, and a stop member 214 adjoining juncture 206 and joining sidewalls 208 and 210 at their ends nearest juncture 206. The frame may be considered to extend from a rearward end at the juncture 206 to a forward end at the transverse wall 212. As shown in FIGS. 5-8, handle 202 may fit into and through juncture 206, may abut stop member 214, and may define (by a majority length of handle 202) a horizontal centerline 121 of the handle 202 and head 204 as shown, for example, in the side elevation views of FIGS. 7 and 8, as well as a longitudinal bisecting line 119 as shown, for example, in the front view of FIG. 5 and rear view of FIG. 6 (bisecting the head 204 longitudinally into two halves). Screws or other fasteners may be placed through openings 207 in juncture 206, securing handle 202 to head 204.

In embodiments, lacrosse stick head 204 may have a traditional pocket configuration, a mesh pocket configuration, or a combination of the two configurations. The traditional pocket may include thongs made of leather or synthetic material strung from forward thong holes 216 in transverse wall 212 to rearward thong holes 218 in stop member 214. To complete the pocket web, the thongs may have nylon strings threaded around the thongs and string laced through string holes in sidewalls 208 and 210, forming any number of diamonds or other shapes (crosslacing).

Figure 5:
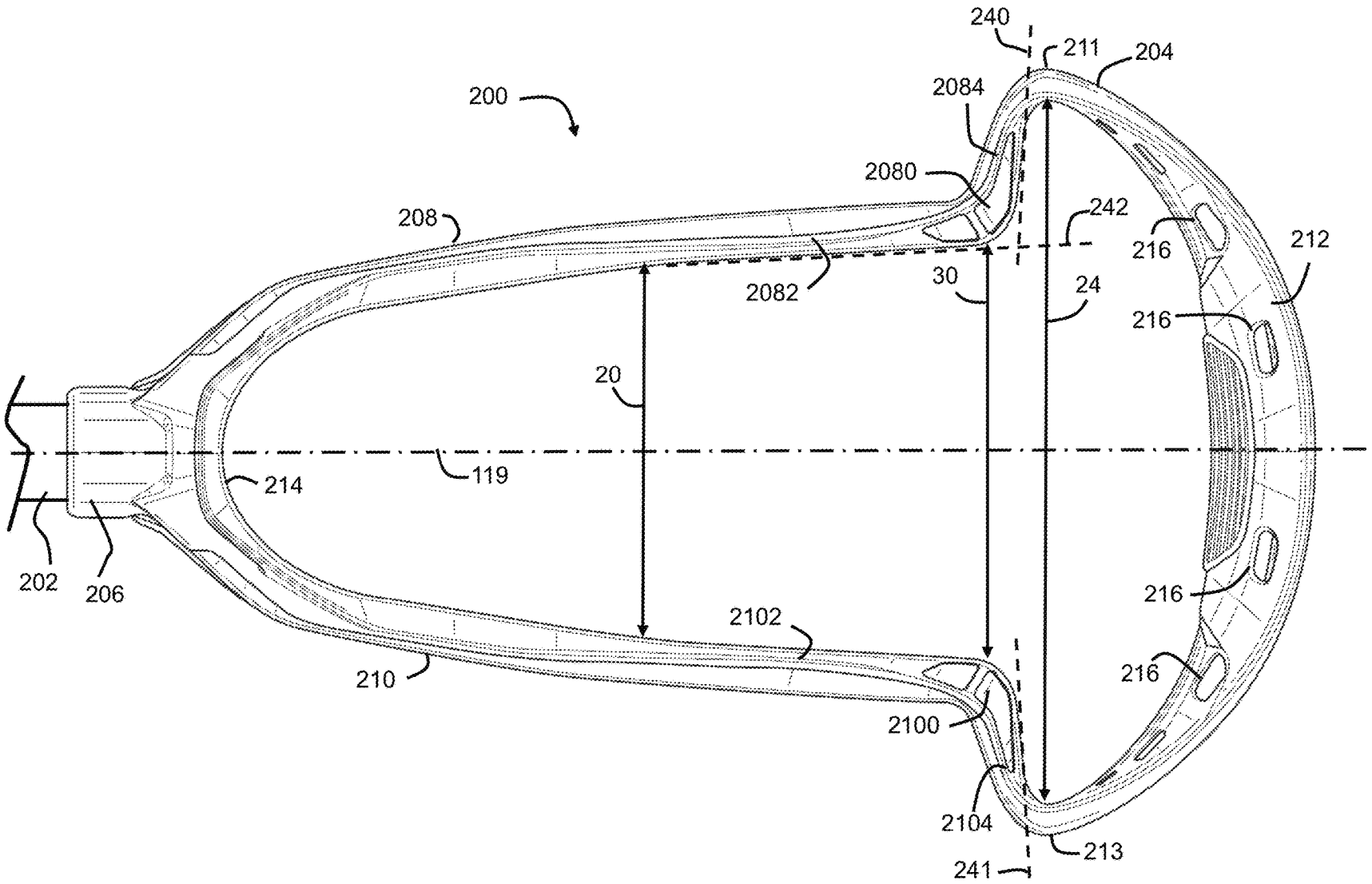
FIG. 5 is a schematic diagram of a front view of the lacrosse head of FIG. 4, shown with a handle.
Figure 6:
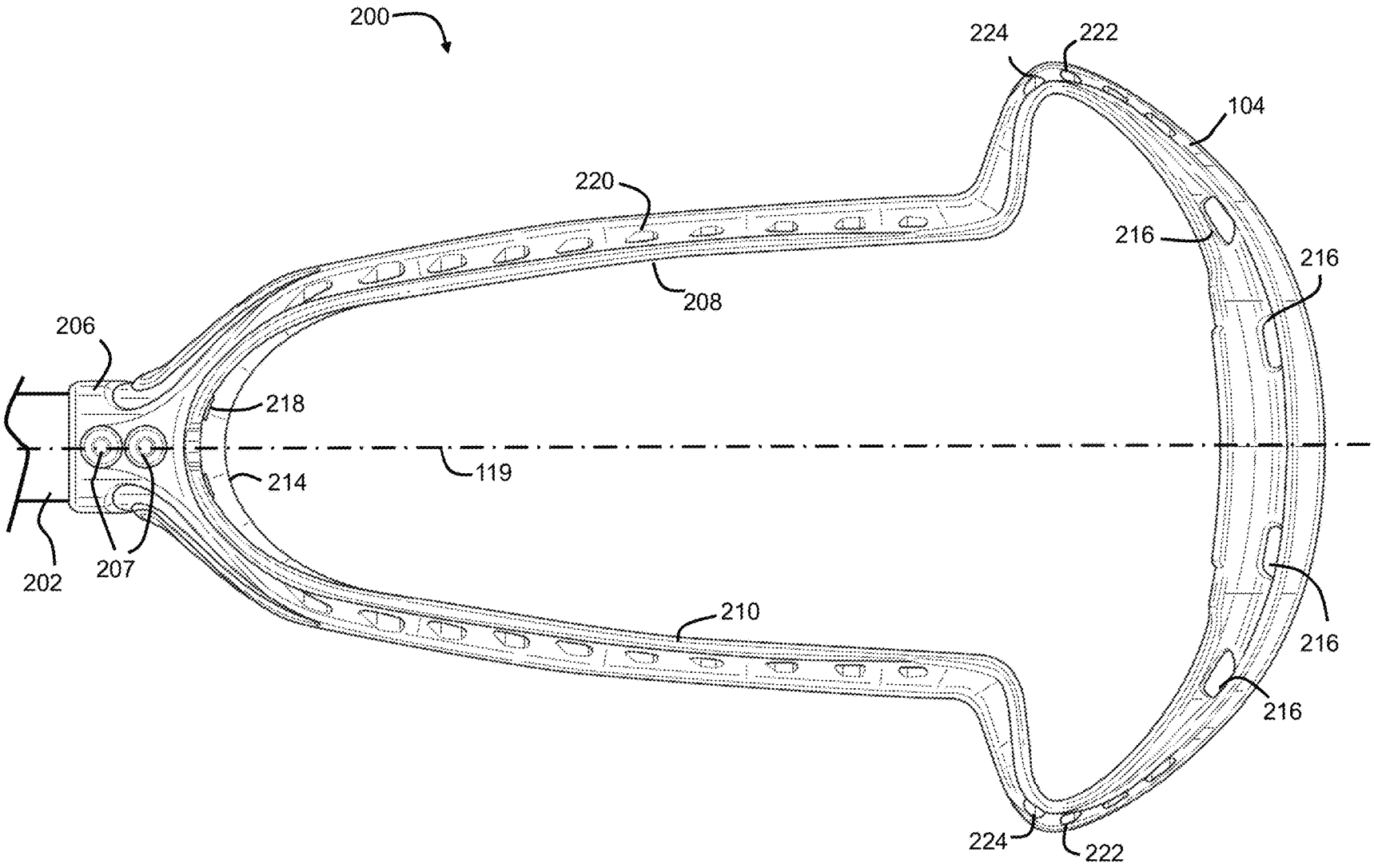
FIG. 6 is a schematic diagram of a rear view of the lacrosse head of FIG. 4, shown with a handle.

In traditional pockets, thongs (not shown in FIGS. 5-8) made of leather or synthetic material may extend from forward thong holes 216 in transverse wall 212 to rearward thong holes 218 in stop member 214 (see, e.g., FIG. 6). As one embodiment, FIGS. 4-10 show four pairs (216, 218) of thong holes that may accept four thongs. Other numbers of pairs may be used. To complete the pocket web, nylon strings may be threaded around the thongs and string may be laced through string holes 220 in sidewalls 208 and 210, forming any number of diamonds or other shapes (crosslacing). In embodiments, one or more throwing or shooting strings may extend transversely between the forward portions of sidewalls 208 and 210, attaching to throwing string holes 224 and a string laced through string holes 222. In embodiments, a thong may not be attached directly to a thong hole, and instead may be connected to a separate material that attaches the thong to the lacrosse head frame and that is easier to adjust through the thong hole. In addition, in some embodiments, a top string (e.g., nylon string) may be strung along the thong holes of the scoop, and the thongs may be attached to the top string.

A completely mesh pocket configuration may use a mesh knitted as a continuous piece of material. This continuous piece of material may attach to the lacrosse head as a single unit. The mesh may be attached to the lacrosse head using transverse lacing, which may reinforce the web of the mesh that is adjacent to the lacrosse head.

As with the embodiment of FIGS. 1-3, embodiments according to FIGS. 5-8 may include provisions for improving the performance of a women's lacrosse stick, especially with respect to draw maneuvers, and within the context of rules governing the configuration of lacrosse heads. In particular, lacrosse head 204 may include provisions for forming in a forward portion of the head a ball containment area that fits within the frame of an opposing conventional lacrosse head.

As shown in FIG. 5, lacrosse head 204 may have a pinched forward portion that positions the innermost edges of sidewalls 208 and 210 relatively close to longitudinal bisecting line 119 to define a relatively narrow ball containment width 30 of head 204 near the widest point 24 along the longitudinal bisecting line 119. In embodiments, the ball containment width 30 is provided as close to widest point 24 as possible. For example, as shown in FIG. 5, rounded interior elbow portions of sidewalls 208 and 210, in combination with a rapid increase in width may allow ball containment width 30 to be disposed close to widest point 24 along the longitudinal bisecting line 119. Embodiments may provide this dramatic change in width by configuring each of sidewalls 208 and 210 with an elbow portion connecting a generally longitudinal portion to a generally lateral portion. For example, as shown in FIG. 5, sidewall 208 may include an elbow portion 2080 joining a generally longitudinal portion 2082 and a generally lateral portion 2084, while similarly, sidewall 210 may include an elbow portion 2100 joining a generally longitudinal portion 2102 and a generally lateral portion 2104. In embodiments, the longitudinal, elbow, and lateral portions refer to the inside structures of the sidewalls, which may provide the ball control aspects described herein.

In embodiments of FIGS. 4-10, ball containment width 30 may be positioned close to widest point 24 by configuring an innermost edge of lateral portion 2084 of first sidewall 208 to extend from the interior rounded corner of elbow portion 2080 to shoulder portion 211 within a range of ±25 degrees of perpendicular to longitudinal bisecting line 119 when viewed from a front view, as represented by the dashed line 240 in FIG. 5. Similarly, an innermost edge of lateral portion 2104 of first sidewall 210 may extend from the interior corner of elbow portion 2100 to shoulder portion 213 within a range of ±25 degrees of perpendicular to longitudinal bisecting line 119 when viewed from a front view, as represented by the dashed line 241 in FIG. 5.

Figure 11:
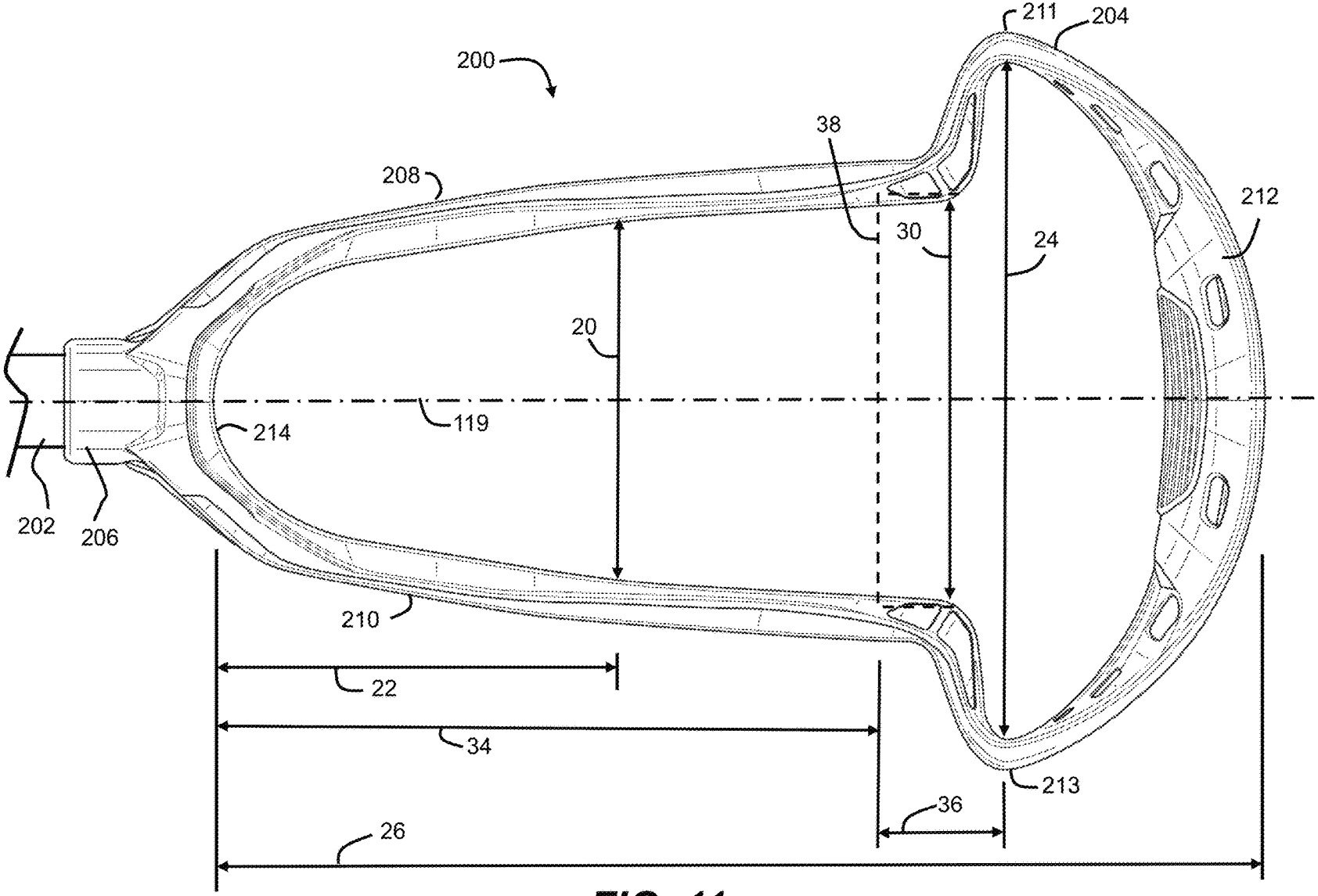
FIG. 11 is a schematic diagram of another front view of the lacrosse head of FIG. 4, shown with a handle and illustrating dimensions of the head.

In embodiments, ball containment width 30 may be disposed within a distance from widest point 24 measured along longitudinal bisecting line 119, equal to or less than about half the diameter of a lacrosse ball 28 with which head 204 is used. For example, referring to FIG. 11, based on widely accepted dimensions of a lacrosse ball, ball containment width 30 may be disposed within a distance 36 of about 32 mm or less from widest point 24, as represented by ball containment zone 38. In a particular implementation, ball containment width 30 may be disposed within a range that begins at approximately 15 mm rearward of the widest point 24 and continues rearwardly to a distance from widest point 24 of approximately 32 mm, over which ball containment width 30 may vary within a range of about 93 mm to about 103 mm. Containment zone 38 may begin at a distance 34 of approximately 163 mm from the center of ball stop 214. Thus, within that containment zone 38, ball containment width 30 may reach a minimum width of at least 103 mm, centered across longitudinal bisecting line 119. In a particular implementation of FIG. 11, distance 34, at which containment zone 38 begins, is approximately 63% of distance 26, based on an approximate distance 34 of 163 mm and an overall length (distance 26) of approximately 259 mm.

In embodiments, to provide a narrow ball containment 30 width in a containment zone 38, lateral and longitudinal portions of a sidewall may be joined by the elbow portion at angles to each other. For example, referring to FIG. 5, longitudinal portion 2082 and lateral portion 2084 may meet at elbow portion 2080 at an angle (between dashed lines 240 and 242) within a range of about 60 degrees to about 130 degrees. In other embodiments, longitudinal portion 2082 and lateral portion 2084 may meet at elbow portion 2080 at an angle within a range of about 75 degrees to about 115 degrees. Longitudinal portion 2102, lateral portion 2104, and elbow portion 2100 may be similarly configured. In a particular implementation, the angle of an elbow portion is approximately 95 degrees.

Figure 12:
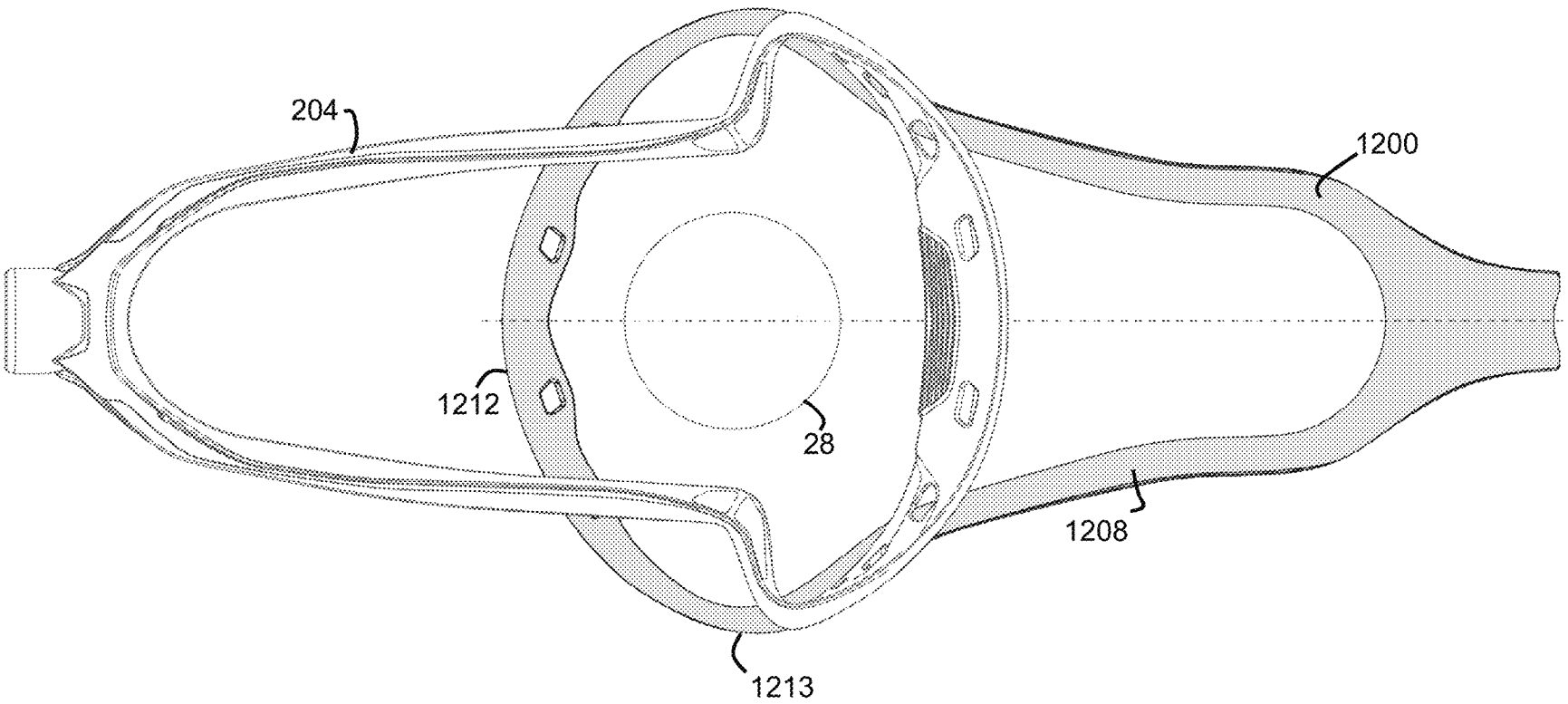
FIG. 12 is a schematic diagram of a front view of a lacrosse head according to an embodiment and a rear view of an opposing conventional lacrosse head, during a draw.

The pinched forward configuration of head 204 provides beneficial performance characteristics, especially in the context of play-starting draws. As shown in FIG. 12, for example, the pinched forward portion of a head 204 according to the present embodiments may rest inside the frame of an opposing lacrosse head 1200. A ball 28 placed between the rear sides of head 204 and head 1200 is therefore closer to the frame of head 204 and therefore more controllable by head 204.

Figure 4:
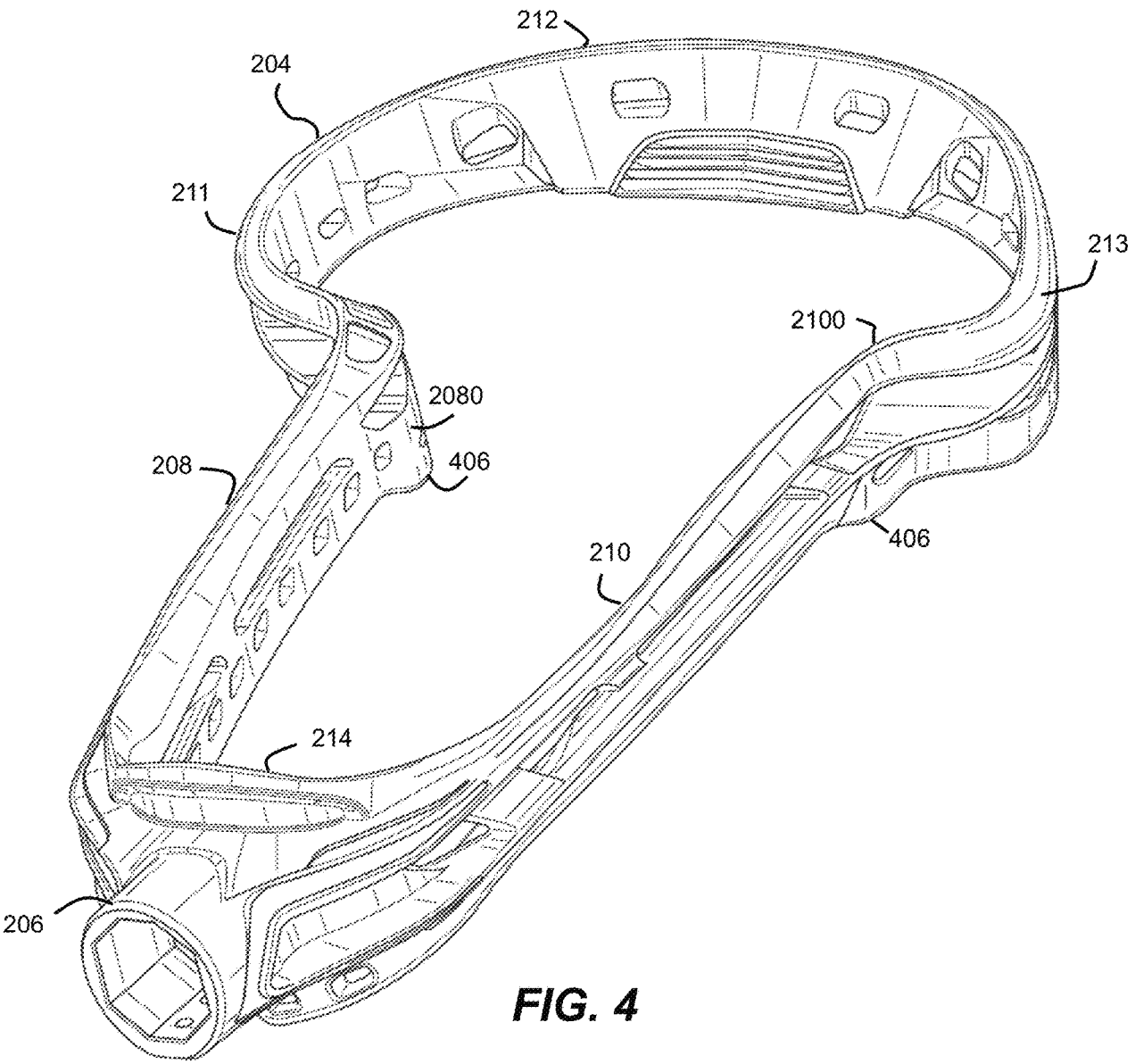
FIG. 4 is a schematic diagram of a front isometric perspective view of a lacrosse head according to an embodiment.

As shown best in FIGS. 4 and 7-10, head 204 may also include provisions for extending deep within the frame of opposing lacrosse head 1200 (in a direction into the sheet of FIG. 12). As shown in the side views of FIGS. 7 and 8, head 204 may include abrupt downward protrusions 406 on each of sidewalls 208 and 210, which when viewed from the side view, protrude downwardly away from horizontal centerline 121, which may be defined by a majority length of handle 202. As shown in FIG. 4, protrusions 406 may be formed by the elbow portions 2100 and 2080, which may also provide ball containment width 30 in this embodiment, as shown in FIG. 5. Protrusions 406 protrude downwardly with respect to the adjacent lower edges 404 of the sidewalls 208 and 210 disposed in the rearward direction, and with respect to the shoulder portions 211 and 213 disposed in the forward direction. The lower edges 404 of sidewalls 208 and 210 may extend generally parallel to longitudinal centerline 121 and may join stop member 214, which descends moving in a rearward direction to a lowermost point 402. In embodiments, lowermost point 402 of stop member 214 and a lowermost point of protrusions 406 may be generally disposed on a plane 408 that is generally parallel to horizontal centerline 121. In addition, lower edges 404 of sidewalls 208 and 210 may be generally parallel to horizontal centerline 121.

Figure 13:
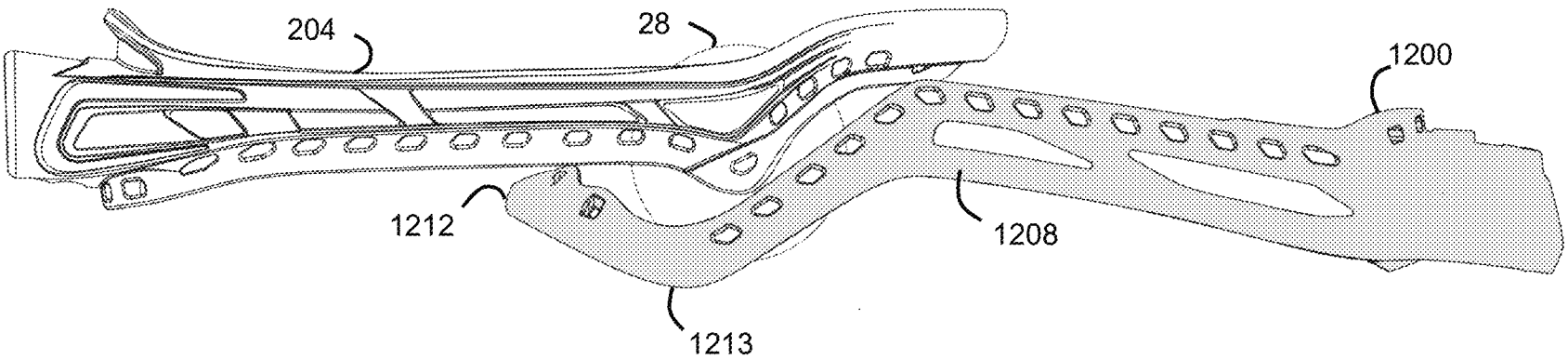
FIG. 13 is a schematic diagram of a side view of a lacrosse head according to an embodiment and an opposing conventional lacrosse head, during a draw.

As shown in FIG. 13, in embodiments, raised lower edges 404 and downward protrusions 406 may cooperate with complementary structures of the back of an opposing lacrosse head 1200 during a draw, and provide a ball containment area within the frame of the opposing lacrosse head 1200. In particular, the recessed area 410 formed by stop member 214, lower edges 404, and protrusions 406 may receive the scoop 1212 of the opposing lacrosse head, while protrusions 406 may protrude into the frame of the opposing lacrosse head 1200 and, notably, inside of the scoop 1212, shoulder portions 1213, and sidewalls 1208 of the opposing lacrosse head. With that configuration, the frame of head 204 may reach up and over the scoop 1212 of the opposing lacrosse head 1200, and extend deep within the frame of the opposing lacrosse head 1200. As shown in FIGS. 12 and 13, a ball 28 placed between the backs of the heads may then be contained inside protrusions 406, such that ball 28 is closer to the frame of head 204 than to the frame of the opposing lacrosse head 1200.

Figure 7:
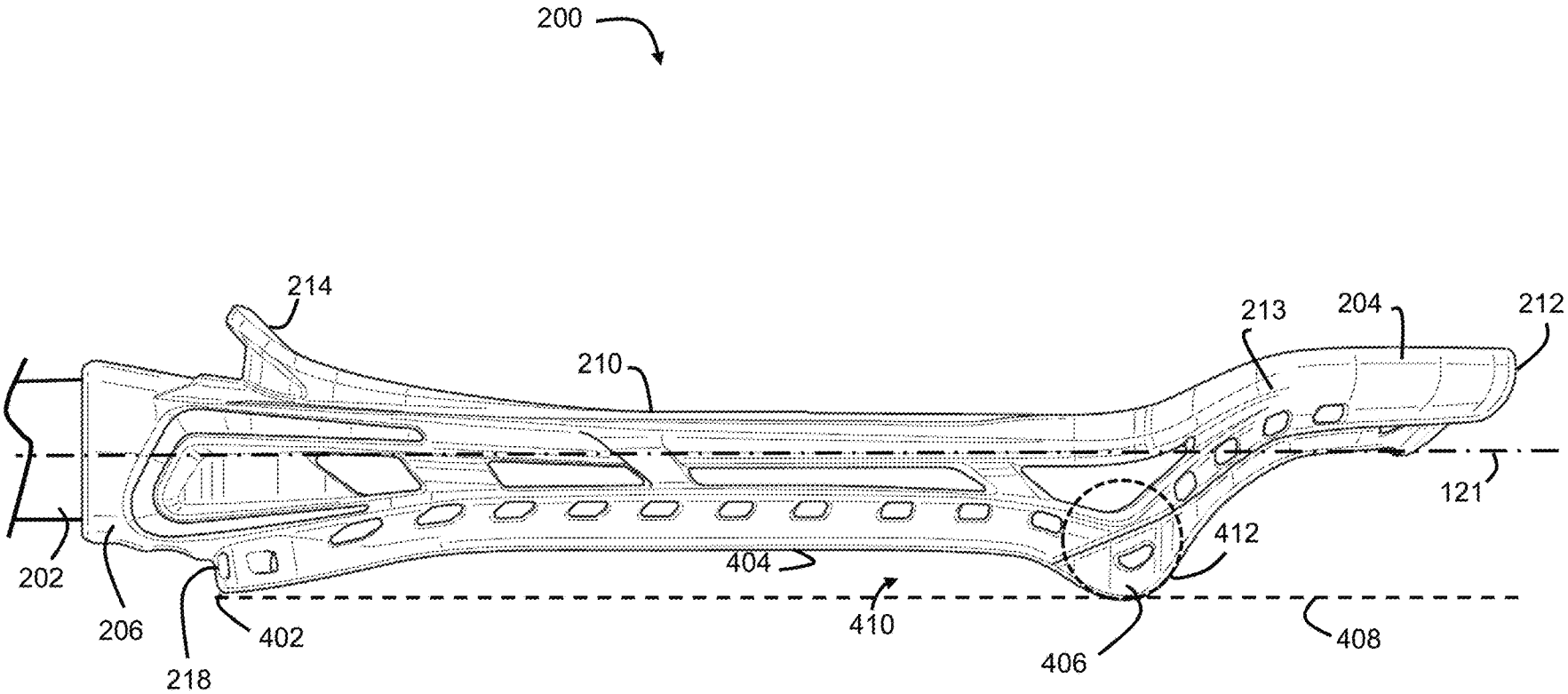
FIG. 7 is a schematic diagram of a side elevational view of the lacrosse head of FIG. 4, shown with a handle.
Figure 8:
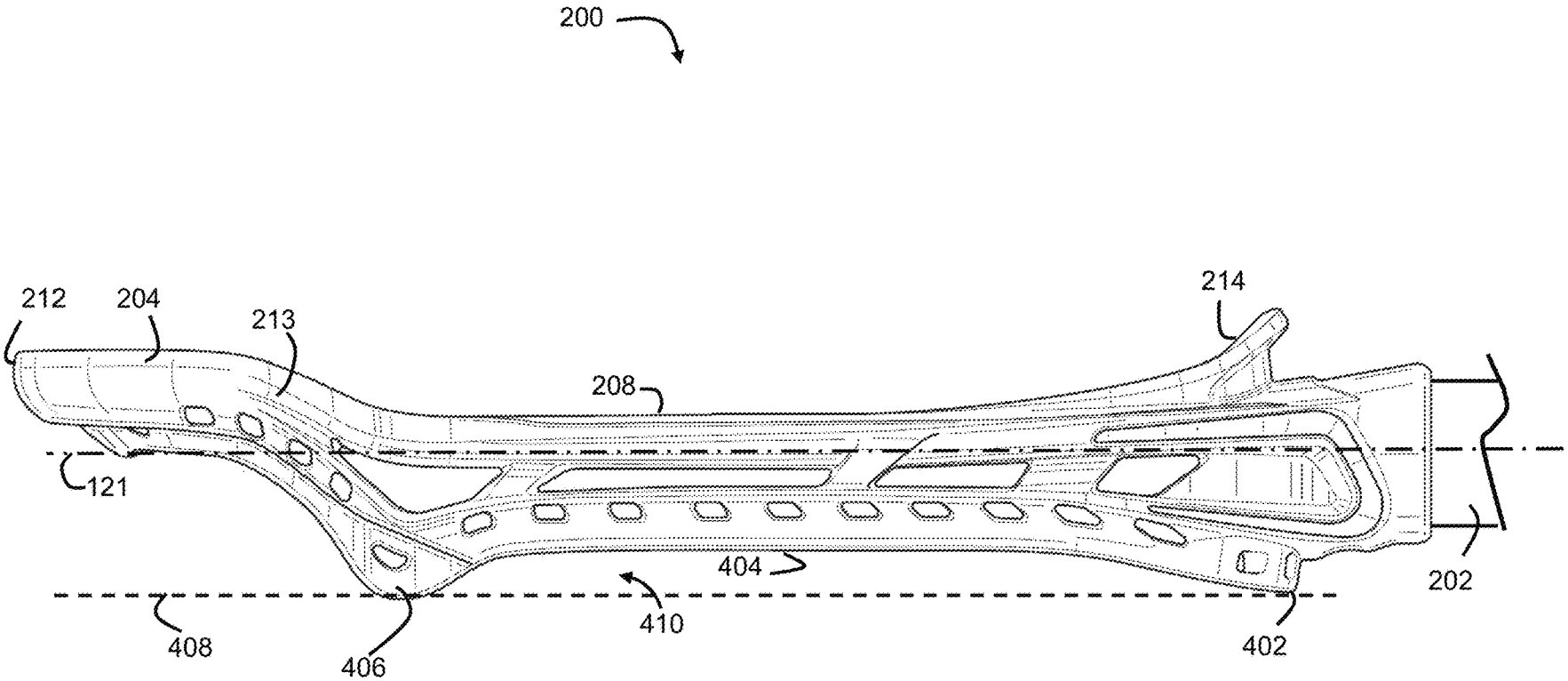
FIG. 8 is a schematic diagram of an opposite side elevational view of the lacrosse head of FIG. 4, shown with a handle.
Figure 9:
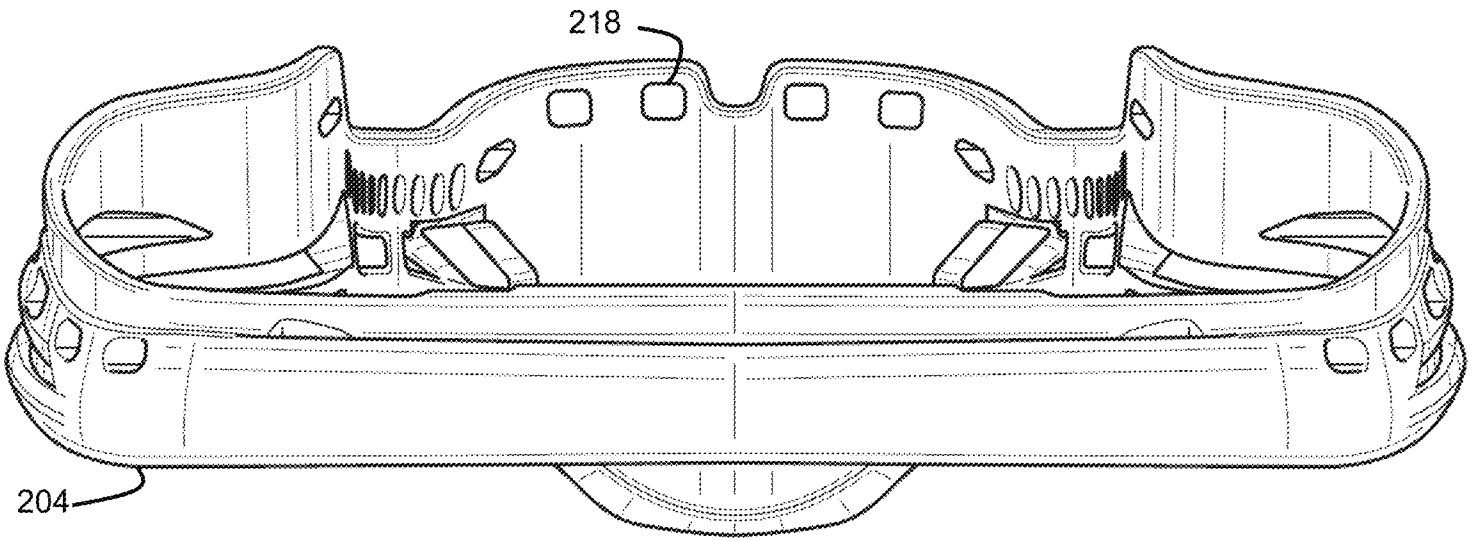
FIG. 9 is a schematic diagram of a top plan view of the lacrosse head of FIG. 4.
Figure 10:
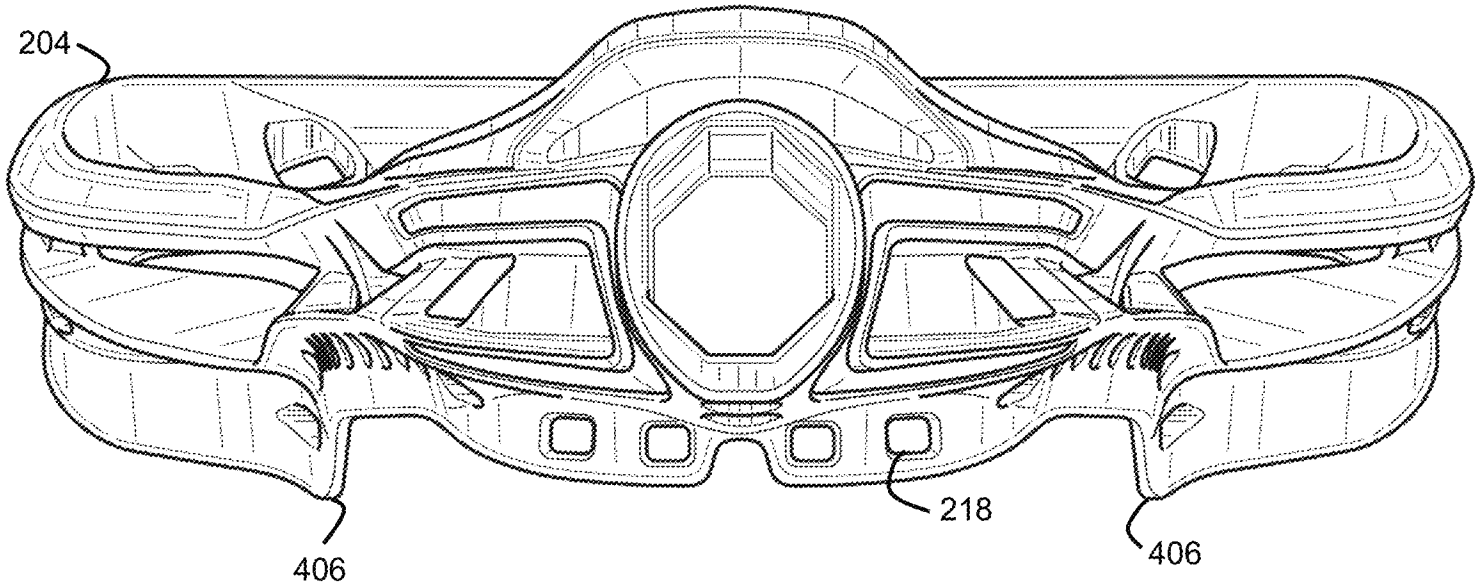
FIG. 10 is a schematic diagram of a bottom plan view of the lacrosse head of FIG. 4.

In embodiments, a first lower edge of sidewall 208 may define a first downward protrusion 406 at the first elbow portion 2080, and a second lower edge of sidewall 210 may define a second downward protrusion 406 at the second elbow portion 2100. As shown in the side views of FIGS. 7 and 8, downward protrusions may be round. In embodiments, as shown in FIG. 7, second lower edge of sidewall 210 at protrusion 406 may lie along an approximately 90 degree arc of circle 412 having a radius of about 12 mm. First lower edge of sidewall 208 at protrusion 406 may be similarly configured. Those sizes and shapes may lead to surprising benefits in smoothly sliding over the scoop and pocket of an opposing lacrosse head without snagging, and in matching the shape of a lacrosse ball, for cupping the ball and improving ball control.

Figure 14:
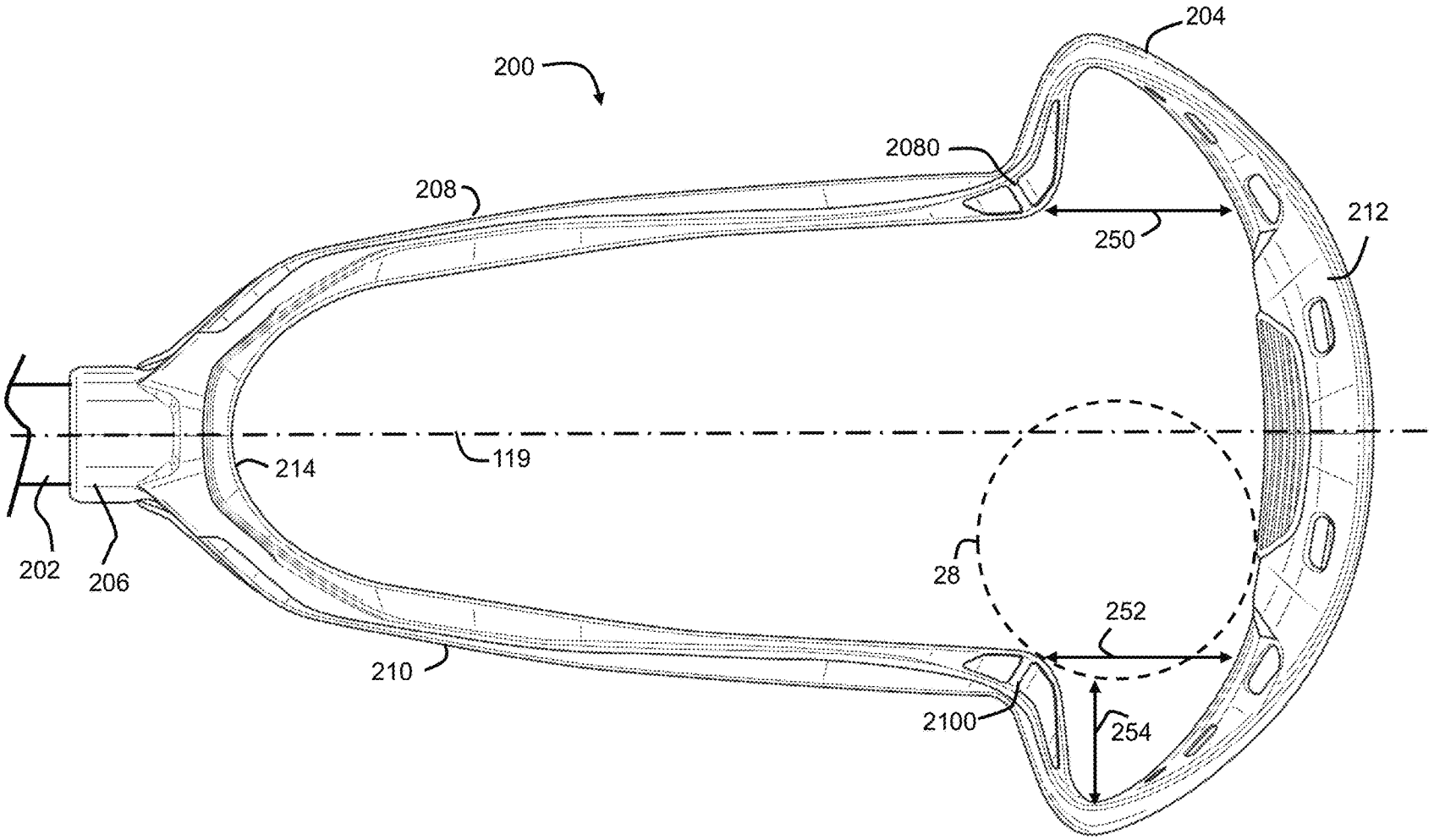
FIG. 14 is a schematic diagram of another front view of the lacrosse head of FIG. 4, shown with a handle and illustrating frame geometries that limit a lacrosse ball from contacting certain portions of the frame.

Embodiments may provide further aspects of ball control relative to frame openings between elbow portions of the sidewalls and the transverse wall. For example, as illustrated in FIG. 14, when viewed from a front view, lacrosse head 204 may define a first gap 250 extending generally parallel to longitudinal bisecting line 119 between an interior edge of first elbow portion 2080 and a first innermost point of transverse wall 212, and a second gap 252 extending generally parallel to longitudinal bisecting line 119 between an interior edge of second elbow portion 2100 and a second innermost point of transverse wall 212, with each of first gap 250 and second gap 252 being shorter than the diameter of a lacrosse ball 28, for example, shorter than 62.7 mm. Such configurations form frame areas that a lacrosse ball cannot enter. As shown in FIG. 14, ball 28 simultaneously contacts the elbow portion 2100 of sidewall 210 and the transverse wall 212, preventing ball 28 from entering the area represented by arrow 254. The pinched frame geometry therefore provides additional ball control by containing a ball toward the center of the forward portion of the lacrosse head, to gain control of the ball over an opponent during a draw. During a draw, the pinched frame geometry, in effect, may suspend the ball away from the shoulder portion of the lacrosse head frame. The pinched frame geometry may also provide a channel for enhanced ball control during throwing and catching.

Figure 20:
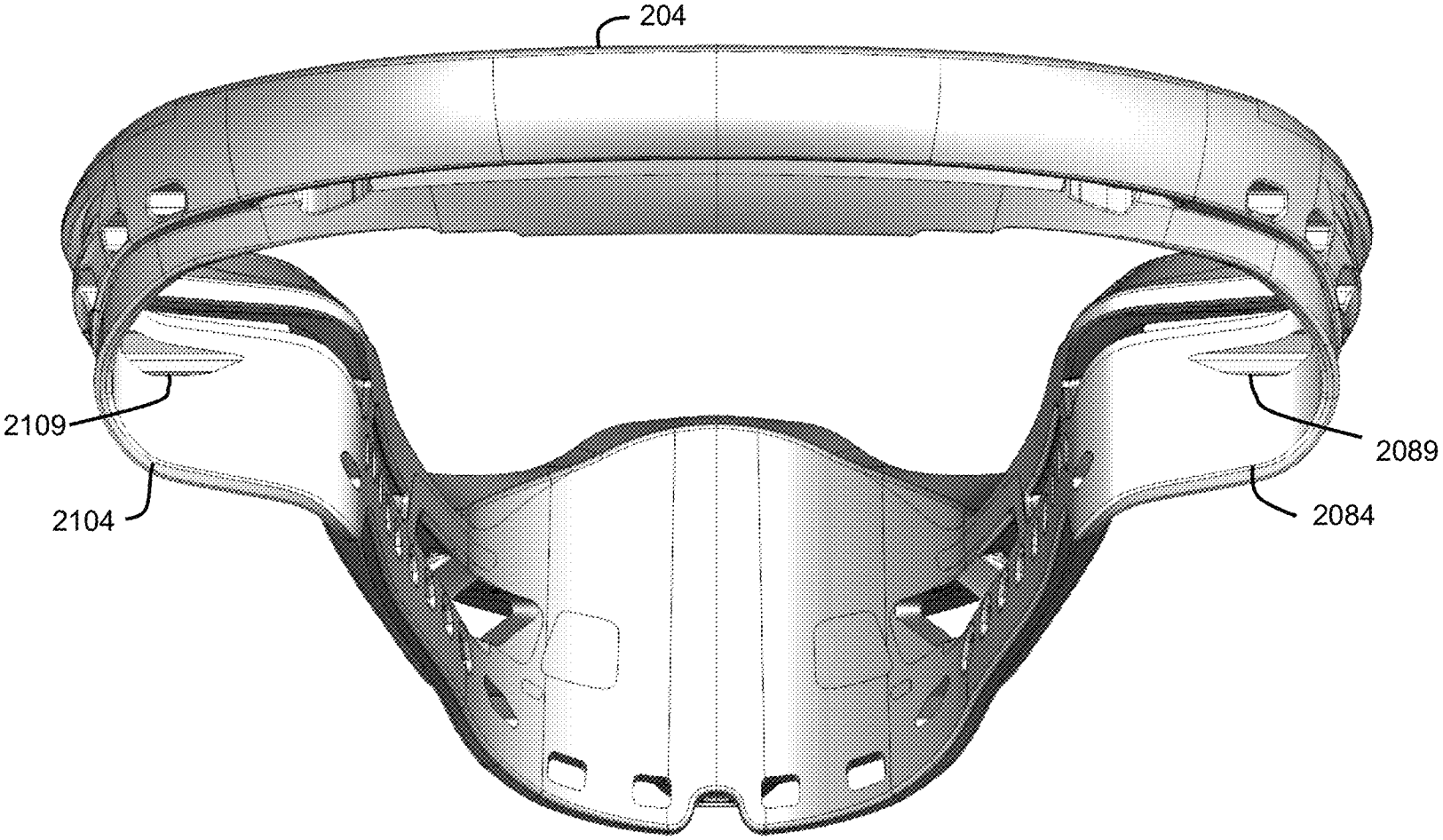
FIG. 20 is a schematic diagram of a top view of a lacrosse head having a pinched ball containment area and stringing channels, according to an embodiment.

In embodiments described herein, sidewall portions of a lacrosse head may extend generally lateral to a longitudinal bisecting line, such as first lateral portion 2084 and second lateral portion 2104 of head 204, shown in FIG. 5. The lateral configuration may present challenges in providing string holes in that area of a head, to which a pocket may be attached. Embodiments may therefore include provisions for receiving stringing members of the pocket. For example, as shown in FIG. 20, head 204 may include a first stringing channel 2089 through lateral portion 2084 and a second stringing channel 2109 through lateral portion 2104. Channels 2089 and 2109 may extend generally along their respective lateral portions 2084 and 2104 and lead to string holes through their respective shoulder portions 111 and 113. As shown in FIG. 20, the walls of channels 2089 and 2090 may gradually decrease in size so that the edges of the channels are angled and rounded, and so that the channels gradually fade away. The configurations of the channels therefore allow for attaching a pocket to the pinched forward portion of head 204.

Overall, based on the aspects of the pinched forward configuration described above, the present embodiments may provide surprising benefits in performance, for example, in terms of ball control, quickness, and durability. The pinched configurations provide draw-specific shapes that allow a player to maneuver her lacrosse head within her opponent's lacrosse head and gain control of the ball. The pinched sidewall configuration may also enable a lightweight head that allows for an easy "reach" once the ball is released, while also providing a strong and durable head that enables a player to "power through" the draw with strength and stability.

During a draw, when a ball is placed between a lacrosse head of the present embodiments and a conventional lacrosse head, the ball is essentially predisposed to fall within the geometry of the present embodiments, due to the pinched face shape. That geometry places the frame of the present embodiments closer to the ball than the frame of the opposing lacrosse head. Therefore, the present embodiments provide significant performance improvements in providing first contact and control when the referee "sets" the ball. In addition, the lower sidewall edge protrusion profile further cups the ball and enhances contact with and control of the ball.

The present embodiments may also provide beneficial post-draw performance, in scooping, cradling, controlling, and throwing a lacrosse ball. The pinched configuration may provide a sturdy forward portion of the head that may provide desired support and stability in competing for ground balls post-draw, and in scooping through the ground. To further improve scooping, the downward protrusions described above (e.g., protrusions 406 of FIG. 7) may allow a lacrosse head to smoothly slide across the ground without snagging on dirt, grass, or turf.

The pinched configurations of the present embodiments may also provide benefits in controlling the ball during catching, cradling, and throwing actions. The ball containment widths provided by the sidewalls may act as pocket channels that keep the ball centered along the longitudinal bisecting line of the head when the ball is received in the forward portion of the head and moves toward the ball stop, when the ball is cradled in the forward portion of the head, and when the ball travels forward in the pocket and out of the pocket during a throw. The ball containment width within the ball containment zone may be fine-tuned to provide a desired balance between controlling a ball during a draw and controlling a ball when receiving or releasing the ball into/from the pocket of the head. For example, a ball containment width slightly larger than the ball may provide a high degree of ball control during a draw but may restrict movement of the ball into and out of the pocket during catching and throwing. In embodiments, a ball containment width that is ⅓ to ½ larger than a ball diameter may provide a suitable balance in performance.

The lacrosse head embodiments described herein may be configured to receive a straight handle or a bent handle. For example, referring to FIGS. 1-3, the socket of the juncture 106 could be configured to receive a handle with an end portion bent at an angle of between about 1-10 degrees, with the horizontal centerline 121 corresponding to the centerline of the majority length of the handle. The bent handle configuration may provide the same benefits as a straight head-handle configuration, for example, in terms of a pinched forward head portion and downward protrusions, which facilitate ball control, especially during draws. Thus, in embodiments, a lacrosse stick having the features described herein may include configurations having a downwardly canted handle, examples of which are described in U.S. Pat. No. 7,488,266, issued Feb. 10, 2009, which is herein incorporated by reference in its entirety.

As used herein, the "centerline" refers to the centerline of the majority of a handle. In the case of a straight handle, the centerline coincides with the center longitudinal axis of the straight handle. In instances of handles having angled end portions inserted into lacrosse head frames, or in instances of angled throat sections of lacrosse heads, the centerline would be defined by the remaining majority length of the handle that extends away from the angled end portion or angled throat, and that is held by a player. For example, referring to FIG. 7, if handle 202 bends within the last few inches (e.g., 3 inches) of the end of the handle 202 at a 10 degree angle, with the bent end portion disposed inside the socket of throat 206, then that bent end portion is to be ignored for purposes of the centerline. Thus, in the example of FIG. 7, the horizontal line 121, which corresponds to the majority length of the handle 202, is the centerline for purposes of the present embodiments.

Examples of suitable materials for a lacrosse head according to the present embodiments include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC). Examples of suitable materials for a handle according to the present embodiments include wood, metal (e.g., aluminum, titanium, scandium, CU31, C405, and C555), plastic, and composites.

As used herein, the term "point" refers generally to a dimensional position and not necessarily to a single point, and may include one or more points.

As used herein, the term "sidewall rail" refers generally to the edge or surface of a sidewall running along the upper or lower portion of the sidewall. In this respect, a sidewall rail does not have to be a bar-like member as illustrated in open-sidewall embodiments described herein, and could instead be an integral member of a closed sidewall configuration, in which the upper edge of the closed sidewall can be considered an upper sidewall rail and the lower edge of the closed sidewall can be considered a lower sidewall rail. In addition, a sidewall rail could also be both bar-like and integral in a partially open sidewall configuration, for example, where the openings do not extend the full length of the sidewall, or in areas where a sidewall typically decreases in height and assumes a solid construction through the height, such as near the stop member or the transverse wall. Accordingly, notwithstanding the particular embodiments illustrated herein, the term "sidewall rail" should be broadly interpreted to cover any upper or lower edge or surface portion of a sidewall.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or lacrosse stick.

It should also be noted that relative terms such as "upper," "lower," "top," and "bottom," are used herein to describe the embodiments as depicted in the accompanying figures and are not intended to be limiting. Unless the context of the usage dictates otherwise, when used in reference to a lacrosse stick or head as a whole, the term "front" refers to the side of the lacrosse stick through which a ball is caught and the terms "back" and "rear" refer to the side of the lacrosse stick that is opposite to the "front" and is where the pocket is disposed. It should also be noted that figures provided herein generally depict the illustrated lacrosse head with the pocket side of the head (i.e., the rear) facing downward. It will be apparent to skilled practitioners that the orientation of a lacrosse stick varies dramatically during play and the relative positions of the elements of the present embodiments will similarly vary from those depicted.

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A lacrosse head for controlling a ball having a diameter, the lacrosse head comprising:

a juncture configured to receive a handle, a majority length of the handle defining a horizontal centerline when the lacrosse head is viewed from a side view and a bisecting line when the lacrosse head is viewed from a front view;

a stop member adjoining the juncture;

a first sidewall extending from the stop member in a forward direction;

a second sidewall extending from the stop member in the forward direction; and a transverse wall connecting the first sidewall and the second sidewall opposite to the stop member, wherein the adjoining transverse wall and first sidewall form a first shoulder portion of the lacrosse head and the adjoining transverse wall and second sidewall form a second shoulder portion of the lacrosse head, wherein the first shoulder portion and the second shoulder portion define an inside widest point of the lacrosse head perpendicularly across the bisecting line when viewed from the front view, wherein within a distance from the widest point in a rearward direction equal to about half of the diameter, a first interior elbow portion of the first sidewall and a second interior elbow portion of the second sidewall define a ball containment width equal to or less than about 1.8 times the diameter, wherein the lacrosse head defines an overall length along the bisecting line from an inside point on the stop member to a top outside point on the transverse wall, wherein the ball containment width is disposed forward of a midpoint of the overall length, wherein, when viewed from the side view, the first interior elbow portion defines at the ball containment width a first downward protrusion that protrudes from a first lower edge portion of the first sidewall that is adjacent to and rearward and upward of the first downward protrusion so as to define a first recessed area, and the second interior elbow portion defines at the ball containment width a second downward protrusion that protrudes from a second lower edge portion of the second sidewall that is adjacent to and rearward and upward of the second downward protrusion so as to define a second recessed area, and wherein the first recessed area and the second recessed area are configured to receive, during a draw, an opposing transverse wall of an opposing lacrosse head placed back-to-back with the lacrosse head such that the first downward protrusion and the second downward protrusion reach into the opposing lacrosse head and hold the ball between the first downward protrusion and the second downward protrusion, within the ball containment width, and closer to the lacrosse head than the opposing lacrosse head.

2. The lacrosse head of claim 1, wherein the diameter is approximately 63 mm and the ball containment width is 114 mm or less.

3. The lacrosse head of claim 1, wherein the first sidewall and the second sidewall define the ball containment width within a distance from the widest point in the rearward direction equal to about ¼ of the diameter.

4. The lacrosse head of claim 1, wherein the first sidewall and the second sidewall define the ball containment width immediately adjacent to the widest point.

5. The lacrosse head of claim 1, wherein when viewed from the front view, the lacrosse head defines a first gap extending generally parallel to the bisecting line in the forward direction from the first interior elbow portion to a first innermost point of the transverse wall, and a second gap extending generally parallel to the bisecting line in the forward direction from the second interior elbow portion to a second innermost point of the transverse wall, and wherein each of the first gap and the second gap is shorter than the diameter of the ball such that the lacrosse head is configured to suspend, during the draw, the ball away from the first shoulder portion and the second shoulder portion of the lacrosse head.

6. The lacrosse head of claim 1, wherein, when viewed from the side view, the first lower edge portion and the second lower edge portion extend generally parallel to the horizontal centerline, and the first downward protrusion and the second downward protrusion protrude generally perpendicularly downward from the first lower edge portion and the second lower edge portion, respectively.

7. A lacrosse head comprising:

a juncture configured to receive a handle, a majority length of the handle defining a horizontal centerline when the lacrosse head is viewed from a side view and a bisecting line when the lacrosse head is viewed from a front view;

a stop member adjoining the juncture;

a first sidewall extending from the stop member in a forward direction;

a second sidewall extending from the stop member in the forward direction; and a transverse wall connecting the first sidewall and the second sidewall opposite to the stop member, wherein the adjoining transverse wall and first sidewall form a first shoulder portion of the lacrosse head and the adjoining transverse wall and second sidewall form a second shoulder portion of the lacrosse head, wherein the first shoulder portion and the second shoulder portion define an inside widest point of the lacrosse head perpendicularly across the bisecting line when viewed from the front view, wherein the first sidewall has a first longitudinal portion extending longitudinally with respect to the bisecting line and a first lateral portion extending from the first longitudinal portion to the first shoulder portion laterally with respect to the bisecting line, wherein, when viewed from the front view, the first longitudinal portion and the first lateral portion meet at a first interior elbow portion at an angle within a range of about 60 degrees to about 130 degrees, wherein the second sidewall has a second longitudinal portion extending longitudinally with respect to the bisecting line and a second lateral portion extending from the second longitudinal portion to the second shoulder portion laterally with respect to the bisecting line, and wherein, when viewed from the front view, the second longitudinal portion and the second lateral portion meet at a second interior elbow portion at an angle within a range of about 60 degrees to about 130 degrees, wherein the lacrosse head defines an overall length along the bisecting line from an inside point on the stop member to a top outside point on the transverse wall, wherein the first interior elbow portion and the second interior elbow portion are disposed forward of a midpoint of the overall length, wherein, when viewed from the side view, the first sidewall defines at the first interior elbow portion a first downward protrusion that protrudes from a first lower edge portion of the first longitudinal portion of the first sidewall that is adjacent to and rearward and upward of the first downward protrusion so as to define a first recessed area, and the second sidewall defines at the second interior elbow portion a second downward protrusion that protrudes from a second lower edge portion of the second longitudinal portion of the second sidewall that is adjacent to and rearward and upward of the second downward protrusion so as to define a second recessed area, and wherein the first recessed area and the second recessed area are configured to receive, during a draw, an opposing transverse wall of an opposing lacrosse head placed back-to-back with the lacrosse head such that the first downward protrusion and the second downward protrusion reach into the opposing lacrosse head and hold a lacrosse ball between the first downward protrusion and the second downward protrusion and closer to the lacrosse head than the opposing lacrosse head.

8. The lacrosse head of claim 7, wherein the first longitudinal portion and the first lateral portion meet at the first interior elbow portion at an angle within a range of about 75 degrees to about 115 degrees, and the second longitudinal portion and the second lateral portion meet at the second interior elbow portion at an angle within a range of about 75 degrees to about 115 degrees.

9. The lacrosse head of claim 7, wherein the first interior elbow portion and the second interior elbow portion are rounded.

10. The lacrosse head of claim 7, wherein, from the midpoint of the overall length in the forward direction, an innermost edge of the first longitudinal portion of the first sidewall extends from the midpoint to the first interior elbow portion and has an angle of divergence from parallel to the bisecting line in at least one of the forward or rearward directions that is not greater than 25 degrees; and wherein, from the midpoint of the overall length in the forward direction, an innermost edge of the second longitudinal portion of the second sidewall extends from the midpoint to the second interior elbow portion and has an angle of divergence from parallel to the bisecting line in at least one of the forward or rearward directions that is not greater than 25 degrees.

11. The lacrosse head of claim 10, wherein an innermost edge of the first lateral portion of the first sidewall extends from the first interior elbow portion to the first shoulder portion within a range of 25 degrees of perpendicular to the bisecting line when viewed from the front view, and wherein an innermost edge of the second lateral portion of the second sidewall extends from the second interior elbow portion to the second shoulder portion within a range of 25 degrees of perpendicular to the bisecting line when viewed from the front view.

12. The lacrosse head of claim 7, wherein, from the midpoint of the overall length moving in the forward direction, a ball containment width between an innermost edge of the first longitudinal portion and an innermost edge of the second longitudinal portion, measured perpendicularly across the bisecting line, reaches a minimum width of 114 mm or less, and wherein the widest interior point is at least 159 mm.

13. The lacrosse head of claim 7, wherein, from a point disposed on the bisecting line 163 mm from an inside point on the stop member moving in the forward direction, a ball containment width between an innermost edge of the first longitudinal portion and an innermost edge of the second longitudinal portion, measured perpendicularly across the bisecting line, reaches a minimum width of 114 mm or less, and wherein the widest interior point is at least 159 mm.

14. The lacrosse head of claim 7, wherein, when viewed from the side view, the first lower edge portion and the second lower edge portion extend generally parallel to the horizontal centerline, and the first downward protrusion and the second downward protrusion protrude generally perpendicularly downward from the first lower edge portion and the second lower edge portion, respectively.

15. The lacrosse head of claim 7, wherein when viewed from the side view:

a first lowermost point of the first downward protrusion, a second lowermost point of the second downward protrusion, and a third lowermost point of the stop member are generally disposed on a horizontal plane that is generally parallel to the horizontal centerline and below the first lower edge portion and the second lower edge portion, the first recessed area is defined by the first lowermost point of the first downward protrusion, the first lower edge portion, the third lowermost point of the stop member, and the horizontal plane, and the second recessed area is defined by the second lowermost point of the second downward protrusion, the second lower edge portion, the third lowermost point of the stop member, and the horizontal plane.

16. The lacrosse head of claim 7, wherein, when viewed from the side view, a first lower edge of the first downward protrusion lies along an approximately 90 degree arc of a circle, and wherein a second lower edge of the second downward protrusion lies along an approximately 90 degree arc of a circle.

17. The lacrosse head of claim 7, wherein when viewed from the front view, the lacrosse head defines a first gap extending generally parallel to the bisecting line in the forward direction from the first interior elbow portion to a first innermost point of the transverse wall, and a second gap extending generally parallel to the bisecting line in the forward direction from the second interior elbow portion to a second innermost point of the transverse wall, and wherein each of the first gap and the second gap is shorter than a diameter of the lacrosse ball such that the lacrosse head is configured to suspend, during the draw, the lacrosse ball away from the first shoulder portion and the second shoulder portion of the lacrosse head.

18. The lacrosse head of claim 17, wherein each of the first gap and the second gap is shorter than 62.7 mm.

19. The lacrosse head of claim 7, wherein the first lateral portion of the first sidewall defines a string channel leading from an interior end portion to a string hole through the first shoulder portion, wherein, in a direction toward the interior end portion, walls of the string channel decrease in size so that an edge of the string channel is angled and rounded, and so that the string channel gradually fades away.

20. A lacrosse stick for controlling a ball having a diameter, the lacrosse stick comprising:

a handle; and a head including a juncture configured to receive the handle, a majority length of the handle defining a horizontal centerline when the lacrosse stick is viewed from a side view and a bisecting line when the lacrosse stick is viewed from a front view;

a stop member adjoining the juncture;

a first sidewall extending from the stop member in a forward direction;

a second sidewall extending from the stop member in the forward direction; and a transverse wall connecting the first sidewall and the second sidewall opposite to the stop member, wherein the adjoining transverse wall and first sidewall form a first shoulder portion of the lacrosse head and the adjoining transverse wall and second sidewall form a second shoulder portion of the lacrosse head, wherein the first shoulder portion and the second shoulder portion define an inside widest point of the lacrosse head perpendicularly across the bisecting line when viewed from the front view, wherein within a distance from the widest point in a rearward direction equal to about half of the diameter, a first interior elbow portion of the first sidewall and a second interior elbow portion of the second sidewall define a ball containment width equal to or less than about 1.8 times the diameter, wherein the lacrosse head defines an overall length along the bisecting line from an inside point on the stop member to a top outside point on the transverse wall, wherein the ball containment width is disposed forward of a midpoint of the overall length, wherein, when viewed from the side view, the first interior elbow portion defines at the ball containment width a first downward protrusion that protrudes from a first lower edge portion of the first sidewall that is adjacent to and rearward and upward of the first downward protrusion so as to define a first recessed area, and the second interior elbow portion defines at the ball containment width a second downward protrusion that protrudes from a second lower edge portion of the second sidewall that is adjacent to and rearward and upward of the second downward protrusion so as to define a second recessed area, and wherein the first recessed area and the second recessed area are configured to receive during a draw an opposing transverse wall of an opposing lacrosse head placed back-to-back with the lacrosse head such that the first downward protrusion and the second downward protrusion reach into the opposing lacrosse head and hold the ball between the first downward protrusion and the second downward protrusion, within the ball containment width, and closer to the lacrosse head than the opposing lacrosse head.

* * * * *